US008881478B2

(12) United States Patent
Gray et al.

(10) Patent No.: US 8,881,478 B2
(45) Date of Patent: Nov. 11, 2014

(54) RATCHETING TAKE-UP DEVICE

(75) Inventors: Daniel M. Gray, McKinney, TX (US); Lisa M. McGurty, Livermore, CA (US); Bryan David Wert, McKinney, TX (US); Thomas Maxwell Strawn, Princeton, TX (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 13/531,159

(22) Filed: Jun. 22, 2012

(65) Prior Publication Data

US 2013/0340366 A1 Dec. 26, 2013

(51) Int. Cl.
*E04C 5/08* (2006.01)

(52) U.S. Cl.
USPC ..... 52/223.14; 52/291; 411/267

(58) Field of Classification Search
USPC ..... 52/223.14, 849, 291, 573.1; 411/433, 411/267
See application file for complete search history.

(56) References Cited

U.S. PATENT DOCUMENTS

| | | | |
|---|---|---|---|
| 179,994 | A | 7/1876 | Brallier |
| 487,721 | A | 12/1891 | De Kalb |
| 518,165 | A | 4/1894 | Thalaker |
| 560,554 | A | 12/1895 | Wiestner |
| 573,452 | A | 12/1896 | Delahunt |
| 582,424 | A | 12/1896 | Hunt |
| 581,551 | A | 4/1897 | Green |
| 601,249 | A | 3/1898 | Geise |
| 807,021 | A | 12/1905 | Falk |
| 856,868 | A | 6/1907 | Heffner |
| 1,005,227 | A | 10/1911 | Jones |
| 1,347,687 | A | 12/1919 | Ellis |
| 1,344,417 | A | 6/1920 | Lovekin |
| 1,374,713 | A | 4/1921 | Bell |
| 1,435,028 | A | 11/1922 | Stewart |
| 1,539,348 | A | 5/1925 | Botscheller |
| 1,589,307 | A | 6/1926 | Svebilius |
| 1,737,543 | A | 11/1929 | Mason |
| 1,746,978 | A | 2/1930 | Winkler |
| 1,867,296 | A | 7/1932 | Woodruff |
| 1,953,354 | A | 4/1934 | Holland-Letz |

(Continued)

FOREIGN PATENT DOCUMENTS

| | | |
|---|---|---|
| CA | 2313735 A1 | 3/2001 |
| CA | 2364582 | 2/2010 |

(Continued)

OTHER PUBLICATIONS

US 5,961,265, 10/1999, Tosiyuki (withdrawn).

(Continued)

*Primary Examiner* — Brent W Herring
(74) *Attorney, Agent, or Firm* — James R. Cypher; Charles R. Cypher

(57) ABSTRACT

A ratcheting take-up device that compensates for imperfect alignment in a tie rod continuity system in the frame of a building wall. The upper ends of the tie rods are tightly clamped within the take-up device by domed segments inserted in a bowl-shaped housing. The segments are also forced together by a compression member in the housing. The domed shape of the segments and the bowl shape of the housing cooperate so that the segments can rotate in any direction to accommodate tie rods that are not perfectly vertical, without a corresponding loss of strength in the connection.

41 Claims, 12 Drawing Sheets

(56) References Cited

U.S. PATENT DOCUMENTS 1,966,780 A 7/1934 Wyrick
2,021,051 A 11/1935 Desbrueres
2,066,541 A 1/1937 Schenk
2,103,601 A 12/1937 Stigall
2,261,537 A 11/1941 Zamarra
2,264,480 A 12/1941 Owen
2,294,745 A 9/1942 Goetz
2,367,480 A 1/1945 Beswick
2,405,889 A 8/1946 Kennedy
2,449,846 A 9/1948 Gilman
2,576,579 A * 11/1951 Donovan ..... 411/267
2,587,560 A 2/1952 Widmer
2,649,625 A 8/1953 Johnson
2,650,844 A 9/1953 Shemorry
2,685,812 A 8/1954 Dmitroff
2,689,987 A 9/1954 Berger
2,690,682 A 10/1954 Passman
2,896,496 A 7/1959 Jansen
3,021,794 A 2/1962 Knox
3,088,784 A * 5/1963 Melton et al. ..... 403/135
3,104,645 A 9/1963 Harrison
3,115,804 A 12/1963 Johnson
3,118,681 A 1/1964 Fuehrer
3,151,652 A * 10/1964 Zahodiakin ..... 411/267
3,153,333 A 10/1964 Chisholm
3,157,215 A 11/1964 Zahodiakin
3,161,174 A 12/1964 Harrison
3,174,386 A 3/1965 Lewis
3,187,621 A 6/1965 Turner
3,219,373 A 11/1965 Sutliff
3,285,120 A 11/1966 Kartiala
3,306,154 A 2/1967 Bailey
3,325,175 A 6/1967 Lower
3,352,341 A 11/1967 Schertz
3,378,891 A 4/1968 Metz
3,429,092 A 2/1969 Perry et al.
3,440,334 A 4/1969 Blomstrand
3,469,492 A 9/1969 Dahl
3,476,010 A 11/1969 Markey et al.
3,479,897 A 11/1969 Holthofer
3,613,201 A * 10/1971 Herbenar ..... 29/898.051
3,695,139 A 10/1972 Howe
3,724,151 A 4/1973 Kaywood
3,728,933 A 4/1973 Grube
3,764,157 A 10/1973 LeBlanc
3,782,061 A 1/1974 Minutoli et al.
3,797,336 A 3/1974 Howe
3,844,137 A 10/1974 Zugel
3,861,814 A 1/1975 Fisher
3,870,332 A 3/1975 Eaton
3,878,757 A 4/1975 Puklus, Jr.
3,948,141 A 4/1976 Shinjo
4,000,681 A 1/1977 Coldren
4,011,397 A 3/1977 Bouche
4,020,734 A 5/1977 Bell
4,037,516 A 7/1977 Hart
4,047,463 A 9/1977 Coldren
4,055,875 A 11/1977 Strickland
4,083,393 A 4/1978 Okada
4,146,951 A 4/1979 Howlett
4,149,446 A 4/1979 Spengler
4,157,876 A * 6/1979 DiGiulio ..... 403/90
4,172,606 A 10/1979 Howe
4,249,426 A 2/1981 Erikson et al.
4,271,654 A 6/1981 Jungbluth
4,286,482 A 9/1981 Marsch
4,363,164 A 12/1982 Okada
4,378,187 A 3/1983 Fullerton
4,403,561 A 9/1983 Schaeflern et al.
4,433,879 A 2/1984 Morris
RE31,713 E 10/1984 Erikson et al.
4,479,747 A 10/1984 Pagel
4,509,724 A 4/1985 Okada
4,604,014 A 8/1986 Frano
4,665,672 A 5/1987 Commins
4,684,284 A 8/1987 Bradley, Jr.
4,701,065 A 10/1987 Orosa
4,703,711 A 11/1987 Haynes
4,708,555 A 11/1987 Terry
4,720,223 A 1/1988 Neights
4,729,703 A 3/1988 Sato
4,761,860 A 8/1988 Krauss
4,801,231 A 1/1989 Everman
4,812,096 A 3/1989 Peterson
4,823,528 A 4/1989 Faw
4,848,454 A 7/1989 Spears
4,850,777 A * 7/1989 Lawrence et al. ..... 411/433
4,875,314 A * 10/1989 Boilen ..... 52/167.1
4,887,948 A 12/1989 Calmettes
4,896,985 A 1/1990 Commins
4,909,012 A 3/1990 Thompson, Jr. et al.
4,919,122 A 4/1990 Kohlenbrenner
4,922,771 A 5/1990 Campbell
4,936,843 A 6/1990 Sohngen
4,954,032 A 9/1990 Morales
4,974,888 A * 12/1990 Childers ..... 292/251
4,979,857 A 12/1990 Wing
5,015,132 A 5/1991 Turner
5,015,133 A 5/1991 Arena
5,048,243 A 9/1991 Ward
5,056,764 A 10/1991 Mochizuki
5,081,811 A 1/1992 Sasaki
5,090,855 A 2/1992 Terry
5,100,275 A 3/1992 Schirrmacher
5,118,237 A 6/1992 Wright
5,168,681 A 12/1992 Ayrapetyan
5,180,268 A 1/1993 Richardson
5,197,176 A 3/1993 Reese
5,199,835 A 4/1993 Turner
5,207,543 A 5/1993 Kirma
5,228,250 A 7/1993 Kesselman
5,249,404 A 10/1993 Leek
5,254,016 A 10/1993 Ganthier
5,265,326 A 11/1993 Scribner
5,308,184 A 5/1994 Bernard
5,316,319 A 5/1994 Suggs
5,324,150 A 6/1994 Fullerton
5,340,252 A * 8/1994 Weddendorf ..... 411/267
5,340,258 A 8/1994 Simon
5,347,771 A 9/1994 Kobori et al.
5,364,214 A 11/1994 Fazekas
5,365,715 A 11/1994 Steinmetz et al.
5,370,483 A 12/1994 Hood
5,378,100 A 1/1995 Fullerton
5,379,563 A 1/1995 Tinsley
5,384,993 A 1/1995 Phillips
5,386,748 A 2/1995 Kilgore
5,398,475 A 3/1995 Kraus
5,411,347 A 5/1995 Bowmer et al.
5,427,488 A 6/1995 Fullerton et al.
5,468,105 A * 11/1995 Iwamoto ..... 411/433
5,487,632 A 1/1996 Hood
5,505,026 A 4/1996 Fausto
5,522,688 A 6/1996 Reh
5,531,054 A 7/1996 Ramirez
5,535,561 A 7/1996 Schuyler
5,540,530 A 7/1996 Fazekas
5,558,481 A 9/1996 Park
5,570,549 A 11/1996 Lung et al.
5,575,129 A 11/1996 Goto
5,582,496 A 12/1996 Ambrico
5,606,839 A 3/1997 Baumann
5,632,129 A 5/1997 Imai et al.
5,664,389 A 9/1997 Williams
5,678,375 A 10/1997 Juola
5,704,572 A 1/1998 Vogel
5,718,090 A 2/1998 Wei-Hwang
5,722,645 A 3/1998 Reitter
5,729,952 A 3/1998 Dahl
5,733,084 A 3/1998 Fullerton
5,743,670 A 4/1998 Ader
5,769,581 A 6/1998 Wallace
5,782,048 A 7/1998 Ramirez
5,809,719 A 9/1998 Ashton et al.

(56) References Cited

U.S. PATENT DOCUMENTS

| | | | | |
|---|---|---|---|---|
| 5,813,181 | A | 9/1998 | Ashton et al. | |
| 5,815,999 | A | 10/1998 | Williams | |
| 5,816,762 | A | 10/1998 | Miura | |
| 5,819,484 | A | 10/1998 | Kar | |
| 5,829,531 | A | 11/1998 | Hebert | |
| 5,839,321 | A | 11/1998 | Siemons | |
| 5,885,034 | A | 3/1999 | Fergusson | |
| 5,906,361 | A | 5/1999 | Carranza | |
| 5,921,042 | A | 7/1999 | Ashton et al. | |
| 5,931,618 | A | 8/1999 | Wallace | |
| 5,967,691 | A | 10/1999 | Lancelot, III | |
| 5,979,130 | A | 11/1999 | Gregg et al. | |
| 5,987,828 | A | 11/1999 | Hardy | |
| 5,988,965 | A | 11/1999 | Fiorell et al. | |
| 5,992,126 | A | 11/1999 | Ashton et al. | |
| 6,007,284 | A * | 12/1999 | Taneichi | 411/267 |
| 6,019,556 | A | 2/2000 | Hess | |
| 6,026,618 | A | 2/2000 | Loke et al. | |
| 6,062,784 | A | 5/2000 | Blessing et al. | |
| 6,068,250 | A | 5/2000 | Hawkins | |
| 6,073,642 | A | 6/2000 | Huang | |
| 6,099,196 | A | 8/2000 | Lancelot, III | |
| 6,112,486 | A | 9/2000 | Ashton et al. | |
| 6,120,723 | A | 9/2000 | Butler | |
| 6,135,687 | A | 10/2000 | Leek et al. | |
| 6,139,113 | A | 10/2000 | Seliga | |
| 6,151,850 | A | 11/2000 | Sorkin | |
| 6,155,019 | A | 12/2000 | Ashton et al. | |
| 6,158,188 | A | 12/2000 | Shahnazarian | |
| 6,161,339 | A | 12/2000 | Cornett, Sr. et al. | |
| 6,161,350 | A | 12/2000 | Espinosa | |
| 6,167,785 | B1 | 1/2001 | Penner | |
| 6,168,455 | B1 | 1/2001 | Hussaini | |
| 6,176,051 | B1 | 1/2001 | Sorkin | |
| 6,192,647 | B1 | 2/2001 | Dahl | |
| 6,195,949 | B1 * | 3/2001 | Schuyler | 52/223.13 |
| 6,244,806 | B1 | 6/2001 | Kato | |
| 6,250,041 | B1 | 6/2001 | Seccombe | |
| 6,256,960 | B1 | 7/2001 | Babcock et al. | |
| 6,257,813 | B1 | 7/2001 | Tanimura | |
| 6,279,877 | B1 | 8/2001 | Davis | |
| 6,282,994 | B1 | 9/2001 | Wei | |
| 6,327,829 | B1 | 12/2001 | Taguchi | |
| 6,327,831 | B1 | 12/2001 | Leek | |
| 6,361,260 | B1 | 3/2002 | Schirrmacher | |
| 6,367,205 | B2 | 4/2002 | Cornett, Sr. | |
| 6,389,767 | B1 | 5/2002 | Lucey et al. | |
| 6,390,747 | B1 | 5/2002 | Commins | |
| 6,406,240 | B1 | 6/2002 | Potter | |
| 6,425,220 | B1 | 7/2002 | Ashton et al. | |
| 6,494,654 | B2 | 12/2002 | Espinosa | |
| 6,513,290 | B2 | 2/2003 | Leek | |
| 6,546,678 | B1 | 4/2003 | Aston et al. | |
| 6,564,519 | B2 | 5/2003 | Lucey et al. | |
| 6,585,469 | B2 | 7/2003 | Commins | |
| 6,625,945 | B2 | 9/2003 | Commins | |
| 6,679,024 | B2 | 1/2004 | Dahl | |
| 6,688,058 | B2 | 2/2004 | Espinosa | |
| 6,688,071 | B1 | 2/2004 | Evers et al. | |
| 6,745,649 | B1 | 6/2004 | Liao | |
| 6,773,002 | B2 | 8/2004 | Adoline et al. | |
| 6,773,198 | B2 | 8/2004 | Copping | |
| 6,826,882 | B2 | 12/2004 | Lucey et al. | |
| 6,860,693 | B2 | 3/2005 | Jones | |
| 6,880,433 | B1 | 4/2005 | Tanimura | |
| 6,925,773 | B2 | 8/2005 | Gregel et al. | |
| 7,007,432 | B2 | 3/2006 | Commins | |
| 7,037,060 | B2 | 5/2006 | Commins | |
| 7,150,132 | B2 | 12/2006 | Commins | |
| 7,171,789 | B2 | 2/2007 | Lucey et al. | |
| 7,287,355 | B2 | 10/2007 | Commins | |
| 7,316,533 | B2 | 1/2008 | Tanimura | |
| 7,422,404 | B2 * | 9/2008 | Kitamura et al. | 411/268 |
| 7,467,787 | B2 | 12/2008 | Adoline et al. | |
| 7,516,582 | B2 | 4/2009 | Leek | |
| 7,744,322 | B2 * | 6/2010 | Taneichi | 411/433 |
| 7,752,824 | B2 * | 7/2010 | Brown et al. | 52/745.21 |
| 7,802,940 | B2 * | 9/2010 | Parker | 403/76 |
| 7,905,066 | B2 * | 3/2011 | Pryor et al. | 52/223.14 |
| 8,051,615 | B2 * | 11/2011 | Mathews et al. | 52/223.13 |
| 8,257,004 | B2 * | 9/2012 | Smith | 411/265 |
| 8,276,334 | B2 * | 10/2012 | Mathews et al. | 52/223.13 |
| 8,281,528 | B2 * | 10/2012 | Clarke | 52/223.7 |
| 8,534,974 | B2 * | 9/2013 | Smith | 411/261 |
| 8,646,339 | B2 * | 2/2014 | Smith | 73/862.338 |
| 8,708,629 | B2 | 4/2014 | Smith | |
| 2001/0002524 | A1 | 6/2001 | Espinosa | |
| 2001/0002529 | A1 | 6/2001 | Commins et al. | |
| 2001/0037611 | A1 | 11/2001 | Cornett, Sr. | |
| 2002/0020137 | A1 | 2/2002 | Commins | |
| 2002/0066246 | A1 | 6/2002 | Leek | |
| 2002/0092383 | A1 | 7/2002 | Nezigane | |
| 2002/0094231 | A1 | 7/2002 | Lee | |
| 2002/0114664 | A1 | 8/2002 | Gregel et al. | |
| 2003/0230032 | A1 * | 12/2003 | Shahnazarian et al. | 52/167.3 |
| 2005/0034391 | A1 | 2/2005 | Leek | |
| 2005/0097843 | A1 | 5/2005 | Giesel et al. | |
| 2005/0108986 | A1 | 5/2005 | Cloyd et al. | |
| 2005/0284057 | A1 | 12/2005 | Commins | |
| 2006/0000318 | A1 | 1/2006 | Hsieh | |
| 2006/0133912 | A1 | 6/2006 | Commins | |
| 2006/0222454 | A1 * | 10/2006 | Parker | 403/122 |
| 2007/0137125 | A1 | 6/2007 | Lucey et al. | |
| 2007/0286702 | A1 * | 12/2007 | Smith | 411/432 |
| 2008/0060296 | A1 | 3/2008 | Espinosa | |
| 2008/0060297 | A1 | 3/2008 | Espinosa | |
| 2008/0099968 | A1 | 5/2008 | Schroeder | |
| 2008/0292391 | A1 * | 11/2008 | Spence et al. | 403/135 |
| 2011/0182697 | A1 * | 7/2011 | Smith | 411/433 |
| 2012/0134764 | A1 * | 5/2012 | Smith | 411/267 |

FOREIGN PATENT DOCUMENTS

| | | | |
|---|---|---|---|
| EP | 0352542 | | 1/1990 |
| FR | 1332745 | | 12/1963 |
| GB | 383460 | A | 11/1932 |
| GB | 558302 | | 12/1943 |
| GB | 590430 | | 7/1947 |
| GB | 1099472 | A | 1/1968 |
| GB | 1384511 | A | 2/1975 |
| GB | 2201216 | A | 8/1988 |
| GB | 2262583 | A | 6/1993 |
| JP | 46001521 | A | 1/1971 |
| JP | 2010196355 | | 9/2010 |
| JP | 201247244 | A | 3/2012 |
| JP | 201364415 | A | 4/2013 |
| SU | 706586 | A1 | 12/1979 |
| SU | 796498 | A1 | 1/1981 |
| WO | WO99/24724 | | 5/1999 |
| WO | WO2006055905 | A1 | 5/2006 |
| WO | WO2008016543 | A2 | 2/2008 |
| WO | WO2008105045 | A1 | 9/2008 |
| WO | WO2008124578 | A2 | 10/2008 |
| WO | WO2011111087 | A1 | 9/2011 |

OTHER PUBLICATIONS

McGraw-Hill Book Company, Inc. "Product Engineering Design Manual" edited by Douglas C. Greenwood, (New York), copyright 1959, (Title and copyright page, pp. 90-97, 316-329), 24 pages.

Arthur B. Richardson, Declaration of Arthur B. Richardson, executed Dec. 21, 2002, 89 pages.

Anchor Tiedown Systems, Inc., "Expansion Jack Washer," Anchor Tiedown System, Inc. Brochure (Mill Valley, CA and Burien, WA), consist of one page, printed one side, 1999.

"Device Keeps Shear Walls Tight," p. 49, May 18, 2000.

"Expansion Jack Washer," Anchor Tie Down Systems, Inc., one page, USA, 1999.

"Thru-Bolt Log Fastening System," Heritage Log Homes, one page, 1999.

Earthbound Seismic Holdown System Using The "Impasse Device", Evaluation Report, ER-5378, ICBO Evaluation Service, Inc. (USA), p. 1-6, Nov. 1, 1997.

(56) References Cited

OTHER PUBLICATIONS

Inquest Engineering, Manufacturers of the Earthbound System, Redefining the State of the Art in Seismic Holdown Technology, Submitted Jun. 28, 2010, 4 pages, USA.
"The Impasse Devise," Inquest Engineering, one page, USA, 1997.
"LocTite, Automatic Self-Locking Nuts," LocTite, 6 pages, USA, Oct. 1992.
"Auto Take-Up," Zone Four Engineered Seismic Solutions, Commins Mfg., Inc., 4 pages, USA, 2000.
"AT Auto Take-Up, "Zone Four Innovative Engineered Solutions, 2 pages, Friday Harbor, WA, USA, 2001.
"ATS-Components," Simpson Strong-Tie Co., Inc., Pleasanton, CA, USA, 2 pages, Submitted Jun. 28, 2010.
Commins Design LLC, "Acceptance Criteria for Shrinkage Compensating Devices and Similar Devices, "Proposed ICBO Take-UP, Devices Acceptance Criteria, Draft 1, Dec. 9, 1999, Commins Design LLC (Friday Harbor, WA), total of 3 pages, (Nov. 2, 1999 and Dec. 9, 1999).
Commins Design LLC, "ICBO Evaluation Service Inc. Evaluation Report, ER-XXXX Dec. 10, 1999, "Proposed, 1.0 Subject Commins Design AT Automatic Take-Up Shrinkage Compensating Devices, Commins Design LLC (Friday Harbor, WA), total of 5 pages, (Dec. 10, 1999).
Commins Design LLC, "AT Auto Take-Up," Shearwall Shrinkage Compensator Solves the Loose Shearwall Problem, Commins Design LLC (Friday Harbor, WA), total of 1 page, (Jan. 3, 2000).
Commins Design LLC, "Commins Design LLC, " Our Solution to Wood Shrinkage Solves Shearwall Problems, Commins Design LLC, (Friday Harbor, WA), total of 2 pages, (Jan. 2000).
Commins, Alfred D., US Provision Patent Application, U.S. Appl. No. 60/156,042, titled "Shrinkage Compensator for Building Tiedowns," total of 31 pages, Sep. 24, 1999.
Alfred D. Commins, Automatic take Up Device, Feb. 10, 1997, US (5 pages).
Alfred D. Commins, Automatic take Up Device, Aug. 15, 1996, US (7 pages).
Alfred D. Commins, Automatic take Up Device, Mar. 6, 1996, US (3 pages).
"Acceptance Criteria for Shrinkage Compensating Devices: AC316," Evaluation Report, ICC Evaluation Service, Inc., USA, p. 1-5, Nov. 2005. (5 pages).
Alfred D. Commins, Automatic take Up Device, Mar. 6, 1996 and Jan. 25, 1996, US (5 pages).
Alfred D. Commins, Automatic take Up Device, Dec. 20, 1995, US (3 pages).
"Holdowns", Simpson Strong-Tie Catalog: Connectors for Wood Construction, Catalog C87H-1, cover page and p. 8, Simpson Strong-Tie Company, Inc., 1987, USA. (2 pages).
"Strong-Tie Rod System", Simpson Strong-Tie Catalog C-HW02, back page and p. 21, Simpson Strong-Tie Company, Inc., Nov. 2002, USA.
ESR-2190—Cinch Nut Shrinkage Compensation Device: Models CN6, CN7, CN8 and CN10, ICC Evaluation Service, Inc., 4 pages, Oct. 1, 2006, USA.
Probolt, "Structural Tie Down System." Product data sheet, installation instructions, and SBCCI Report No. 9916. 1999 Probolt, Orlando, Florida. (18 pages).
"Seismic Solutions Structural Tie Downs", Quake-Tie: The Superior Hold-Down Solution Brochure, Seismic Solutions, Inc., Glen Ellen, CA, 9 pages, Jan. 1998.

* cited by examiner

RATCHETING TAKE-UP DEVICE

BACKGROUND OF THE INVENTION

The present invention relates generally to building construction and reinforcement, and specifically to a continuity system that resists tension from wind uplift forces or overturning forces from wind or seismic events while compensating for the downward settling of buildings caused by shrinkage of wooden members. Most specifically, the present invention relates to a ratcheting take-up device that reduces slack due to wood shrinkage and building settling in a hold-own system of continuous rods, eases installation and compensates for imperfectly aligned rods.

A continuity system is a secondary support system that ties walls or other building elements together and resists lateral overturning forces or uplift forces from events such as earthquakes or strong winds. Earthquake and wind forces produce overturning and uplift loads in the building, which load the building elements in overturning or uplift with respect to the building foundation. A continuity system resists such movements of the building elements. A continuity system generally comprises a plurality of interconnected vertically-oriented elements, typically metal rods and bearing plates, or hold-owns, that provide a discrete structural mechanism or load path framework for the transfer of loads through the building from the structural elements that are intended to resist such forces, such as roof or floor diaphragms and shearwalls, to the continuity system, and then to the foundation. For example, the presence of a continuity system enables wall panels to resist overturning and/or moments that might damage or destroy the wall.

A known continuity system is described in U.S. Pat. No. 4,875,314 ("the '314 patent"), the entire disclosure of which is hereby incorporated herein by reference. The '314 patent describes a system in which at least one tie rod is connected to the foundation through a simple threaded coupler and a foundation anchor. Although the tie rod system can be used in a single-story structure, it is particularly suited to multistory structures, as illustrated in the '314 patent. In a multistory structure, a series of anchor elements is used to couple multiple tie rods in a line from the foundation to the top plate of the top story of the structure. The anchor elements of the '314 patent, in addition to coupling tie rods together, are used to secure the tie rods at each level of the structure to eliminate initial slack in the system. The principal shortcoming of the system of the '314 patent is the lack of a means of compensating for slack that builds up in the system as the wood structural members shrink over time. As slack builds up in the system, the system's capacity to resist uplift is correspondingly reduced.

The prior art includes a number of technical solutions to the problem of increasing slack in continuity systems. Simpson Strong-Tie Company's Anchor Tiedown System uses the TUD and ATUD take-up devices, as well as the CTUD coupling take-up device. The CTUD coupling take-up device is the subject of U.S. Pat. No. 7,905,066, granted to Steven E. Pryor et al. All three devices are driven by a torsion spring. The TUD and ATUD are slipped over the tie rod between a horizontally disposed member and a nut threaded onto the tie rod, and they expand to fill the space as it expands enlarges. The CTUD threads onto and couples the vertically-aligned ends of two tie rods, drawing the two together to maintain tight connections between the wood and steel elements as the wood structural members shrink over time.

Similar continuity systems with ratcheting take-up devices are described in U.S. Pat. No. 6,007,284 the entire disclosure of which is hereby incorporated herein by reference, and U.S. Pat. No. 7,744,322, the entire disclosure of which is also hereby incorporated herein by reference. These devices, while similar in both basic form and function to the present invention, lack inventive features of the present invention.

The ratcheting take-up device of the present invention eases installation of continuity systems, compensates for tie rods that are not perfectly perpendicular to the top and bottom plates, and takes up slack in the continuity system after installation.

SUMMARY OF THE INVENTION

The take-up device of the present invention has a plurality of insert segments with concavities that form an inner bore. The insert segments are contained within a housing that has an outer bore. The lower portion of the outer bore in the housing narrows. The lower portions of the insert segments and the lower portion of outer bore contained by the housing have frusto-spherical bearing surfaces. The insert segments are formed and arranged so that they grasp and hold a tie rod received in the housing when a wind uplift or a shear wall overturning force is applied to the wall of which the take-up device is a part. When a wind uplift or a shear wall overturning force is applied to the wall, the tie rod is placed in tension from an anchoring, reactive force pulling on the tension rod from below the housing while the structural member that is part of the wall to which the take-up device is attached pushes upwardly on the housing of the take-up device. The tie rod, the insert segments and the housing are formed such that when the tie rod moves downwardly with respect to the housing, the insert segments will be pulled downwardly in the housing as well. The tension on the tie rod combined with the narrowing in the lower portion of the outer bore of the housing causes a constriction of the insert segments about the tie rod forcing them to grasp and hold the tie rod, preventing any further downward movement of the tie rod with respect to the housing and thus to the building component to which the housing is attached.

An important advantage of the take-up device of the present invention is that its frusto-spherical bearing surfaces allow it to anchor imperfectly aligned tie rods by swinging about a central pivot on the vertical axis of the device in any direction without a reduction in the bearing surfaces or the strength of the anchorage. The lower portions of the insert segments collectively have the geometry of a spherical segment—a spherical cap with the top truncated, or a spherical frustum. The first frusto-spherical bearing surface is the outward-facing, lower surfaces of the insert segments taken together. The second frusto-spherical bearing surface is the inward-facing lower portion of the outer bore of the housing. The insert segments are inserted in the outer bore of the housing. The frusto-spherical sections of each, solid in the segments and hollow in the outer bore, are closely matched. Because the lower bearing surfaces of the insert segments are able to rotate or swing to be in contact with a matching surface in the lower portion of the outer bore of the device housing, there is little or no reduction in the net bearing interface when the rod received by the nut segments is out of alignment with the vertical axis of the housing.

A further advantage of the present invention is that the housing and insert segments are shaped and arranged to allow a tie rod to be quickly inserted through the inner bore formed by the insert segments by pushing the tie rod up through the bore. When a tie rod is first inserted up into the housing, the upward movement of the tie rod forces the insert segments apart from a constricted position—the constriction preferably caused by the downward force of gravity and possibly by a compression member placed above the insert segments, combined with the narrowing in the lower portion of the outer bore of the housing—to the width of the tie rod. The interface between the surfaces of the tie rod and the insert segments creates a ratcheting action as the tie rod is pushed up and the insert segments move up and out laterally, allowing the tie rod to be inserted as far as needed into the housing for installation. When the building shrinks, the relative movement of the tie rod and the housing is similar to movement during installation. The relative upward movement of the rod with respect to the housing pushes the insert segments up and out laterally, and gravity and any relative downward movement of the tension rod as well as the usual tension that is placed on the rod once it is installed pulls the insert segments downwardly and inwardly in combination with the narrowing of the outer bore of the housing and thus against the rod, holding it with respect to the housing.

A further object of the present invention is to provide insert segments that are made with flat tops and bottom edges and in the preferred embodiment are compressed by a member with a flat surface so that it allows tie rods to be inserted with a minimal risk of jamming the take-up device because the insert segments are held in place by a flat, hard washer above, which interface with flat surfaces at the tops of the insert segments to stabilize them as they expand away from and constrict towards the central vertical axis of the device. Another object of the present invention is to provide the housing with a small ledge which interfaces with the bottom edges of the insert segments to stabilize them as they expand away from and constrict towards the central vertical axis of the device.

DETAILED DESCRIPTION

For clarity and convenience, the take-up device 1 of the current invention is described in a single, most common, orientation (except as noted otherwise) in which a top faces up and a bottom faces down. The take-up device 1 can, nevertheless, be installed in essentially any orientation, so that a top can face down or to the side and a bottom can face up or to the side.

Figure 1:
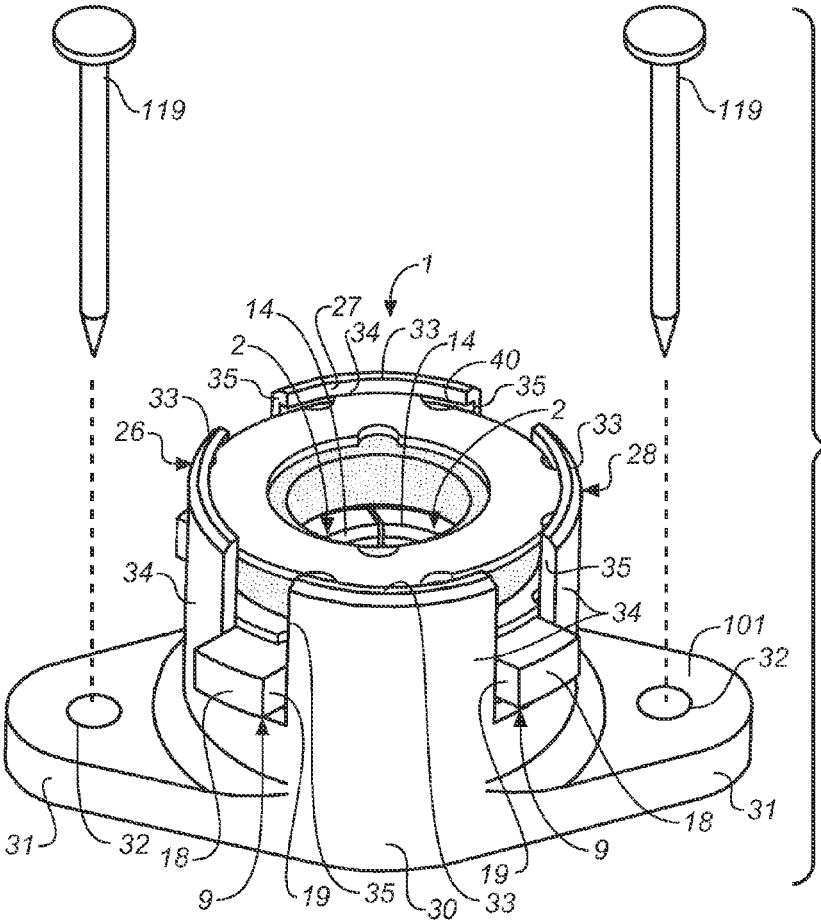
FIG. 1 is a perspective view of the take-up device of the present invention.
Figure 2:
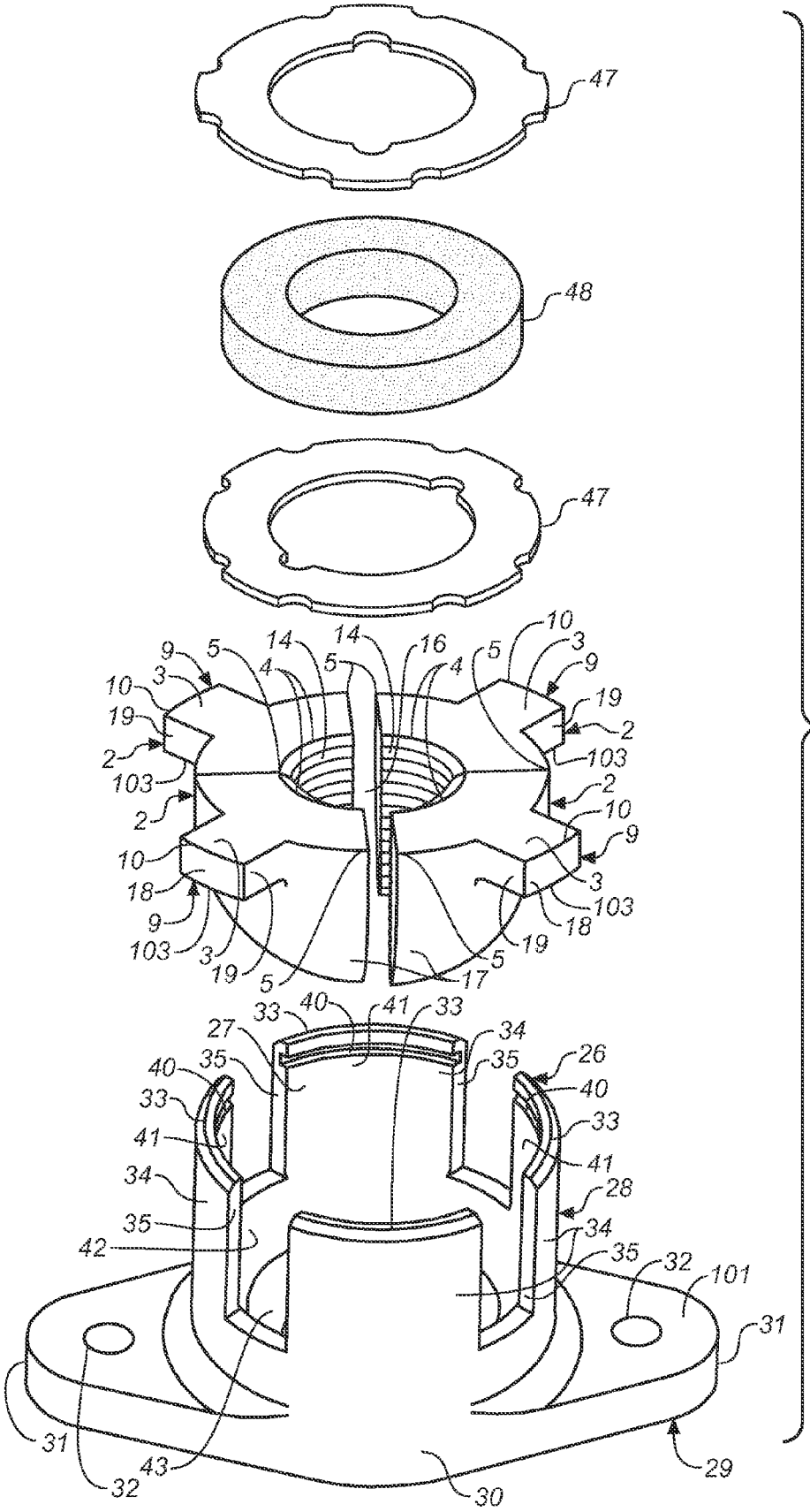
FIG. 2 is an exploded perspective view of the take-up device of the present invention.
Figure 11:
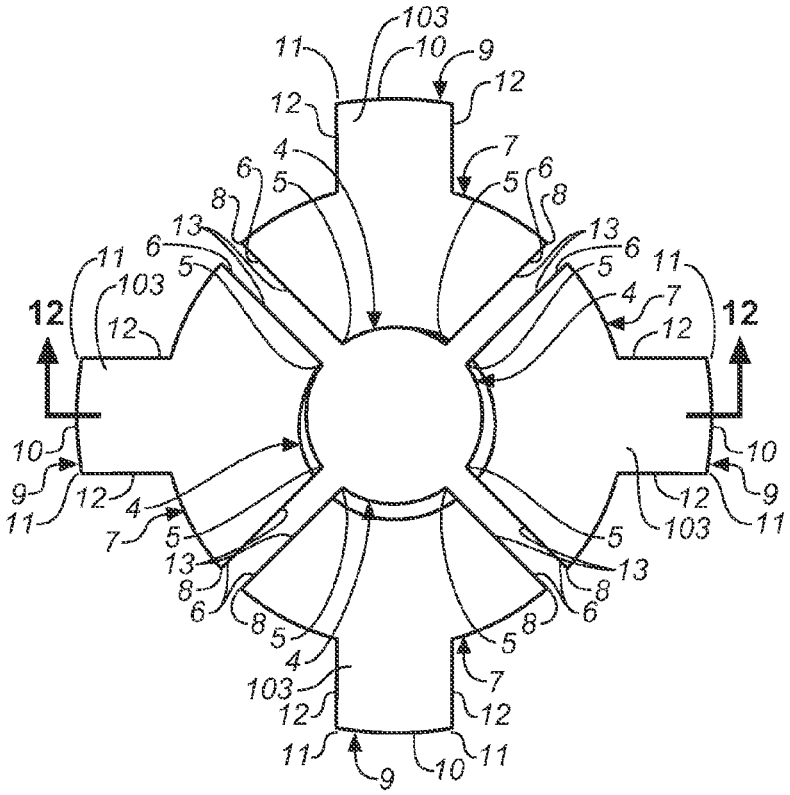
FIG. 11 is a top plan view of the insert segments of the take-up device of the present invention.

As best shown in FIGS. 2 and 11, the take-up device 1 of the present invention preferably has four insert segments 2 arranged sectionally around an inner bore 16. Greater or lesser numbers of insert segments 2 are possible, but four is preferred. The insert segments 2 are designed to grasp a preferably vertical tie rod or threaded bolt 24. Preferably, vertical tie rod 24 is a least threaded where it is grasped by insert segments 2. Vertical tie rod 24 can be wholly threaded, partially threaded, or unthreaded, although if is unthreaded it is preferable to have a grooved surface that can mate with similar grooves on the insert segments 2 for achieving design load values, although alternate methods of the grasping of the insert segments 2 of the tie rod 24 are encompassed within the invention. The insert segments 2 preferably surround the tie rod or threaded bolt 24, but with gaps between the insert segments 2. Preferably, each insert segment 2 has a substantially planar top surface 3.

The top surface 3 need not be planar, but it is generally advantageous to maximize the area of the top surface 3 because the top surface 3 is where the insert segments 2 are pushed down by compression member 46 which helps to prevent the insert segments 2 from rotating too far out of their upright orientation when the tie rod 24 pushes them upwardly and outwardly during shrinkage of the building or installation of the tie rod 24, and thus the insert segments 2 are properly positioned to grasp the tie rod 24 as firmly as possible when the tie rod 24 is in tension again. The top surface 3 of each insert segment 2 preferably has a concave inner bore-defining edge 4 that has a first end 5 and a second end 5. The inner bore-defining edge 4 is preferably an arc 4. Preferably, a substantially straight first side edge 6 connects the first end 5 of the concave inner bore-defining edge 4 to the first end 8 of a convex outer bore edge 7. Preferably, a substantially straight second side edge 6 connects the second end 5 of the concave inner bore-defining edge 4 to a second end 8 of the convex outer bore edge 7. The first and second substantially straight side edges 6 of the top surface 3 are preferably orthogonal to each other. The outer bore edge 7 is preferably a nearly 90-degree arc 7 except where the arc 7 is interrupted by a tab 9 that projects from the convex outer bore edge 7. Preferably, the tab 9 has a slightly curved outer edge 10 with first and second ends 11 that are connected to the arc 7 by first and second substantially straight side edges 12, respectively. The tab 9 is preferably formed as an integral part of the insert segment 2, rather than as a separate part attached to the insert segment 2.

Figure 14:
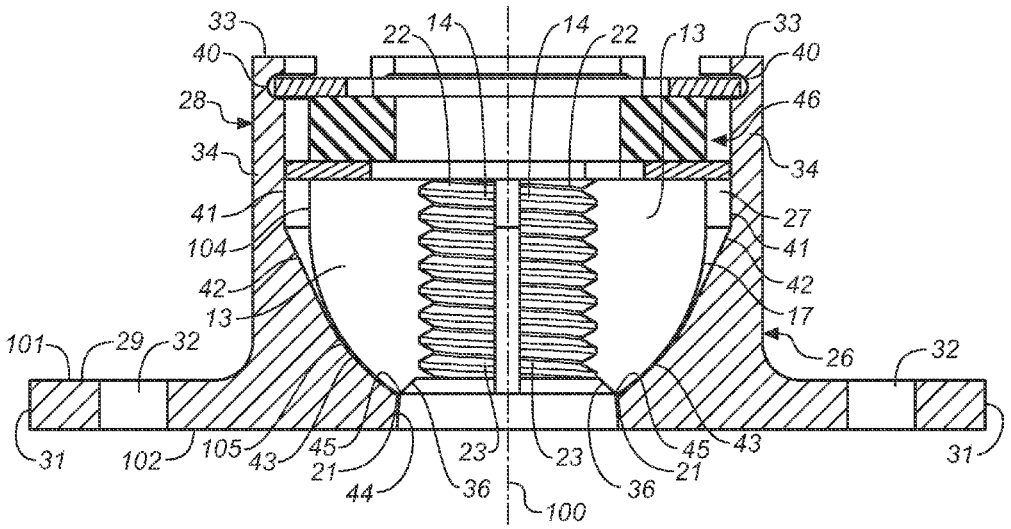
FIG. 14 is a cross-sectional elevation view of the take-up device of the present invention taken along view line 14-14 in FIG. 13.
Figure 15A:
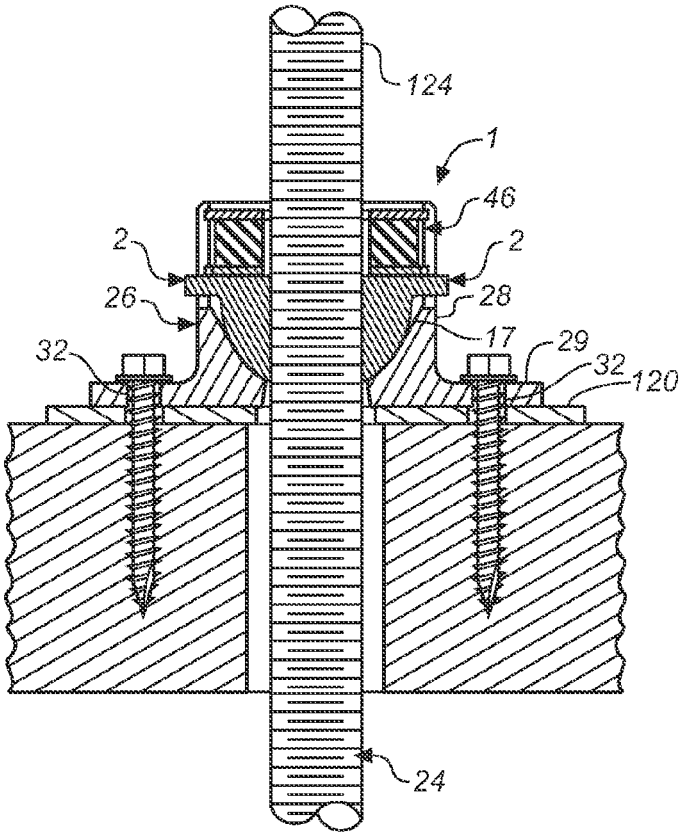
FIG. 15A is a cutaway elevation view of a connection made with the take-up device of the present invention, showing a threaded rod perfectly centered within and parallel to the inner bore.
Figure 15B:
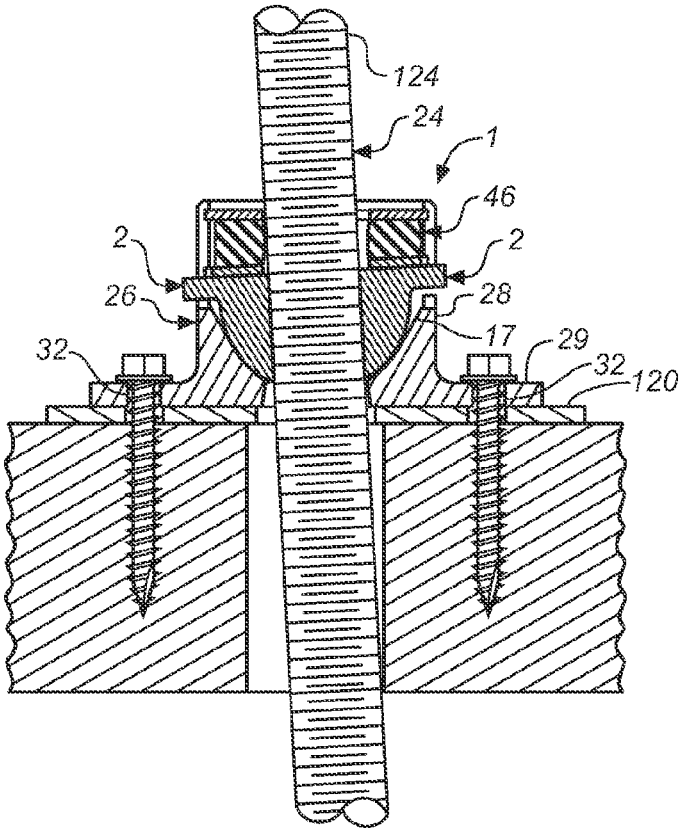
FIG. 15B is a cutaway elevation view of a connection made with the take-up device of the present invention, showing a threaded rod imperfectly centered within and not parallel to the inner bore, with the insert segments rotated to accommodate the angle of the threaded rod.

In the currently preferred embodiments of the invention optimized to grasp a ⅜" or ½" diameter threaded rod, in which there are four insert segments 2, as shown in FIGS. 11 and 14, the distance between opposite outer edges 10 of the tabs 9 of opposed segments 2 is preferably 1.375 inches.

Figure 12:
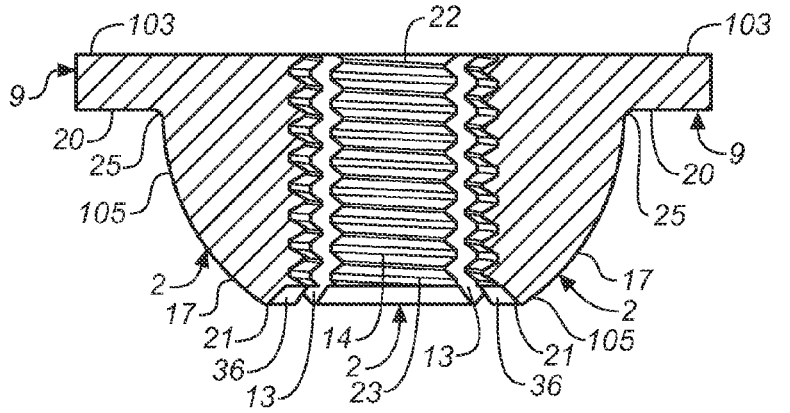
FIG. 12 is a cross-sectional elevation view of the insert segments of the take-up device of the present invention taken along view line 12-12 in FIG. 11.
Figure 13:
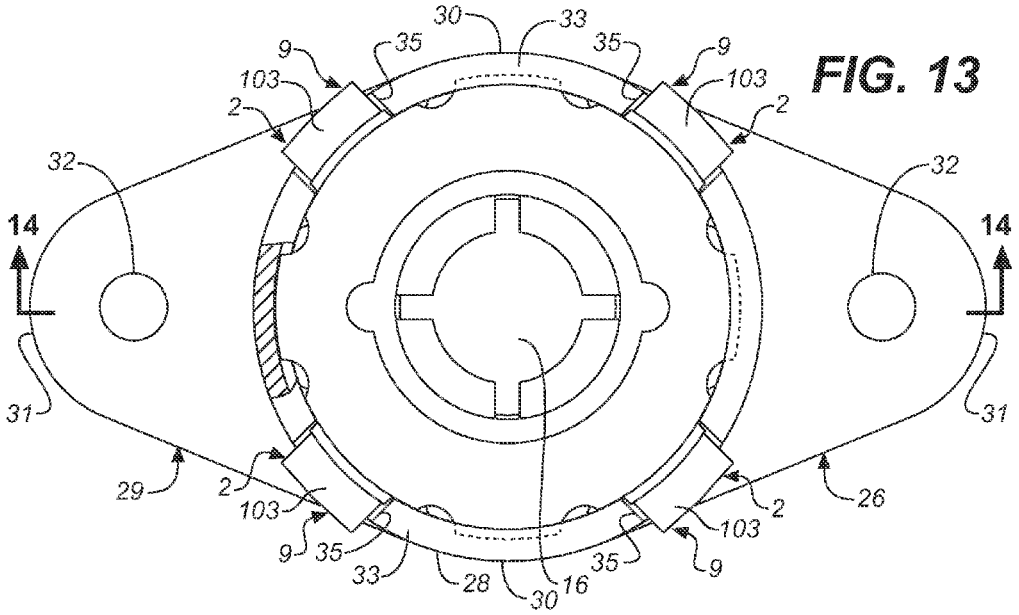
FIG. 13 is a top plan view of the take-up device of the present invention.
Figure 17:
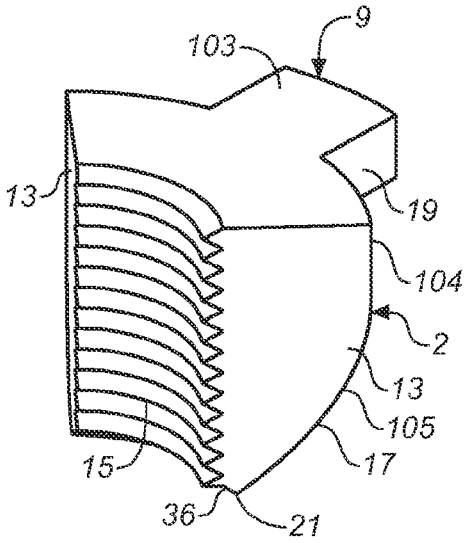
FIG. 17 is a perspective view of an insert segment of the take-up device of the present invention.
Figure 18:
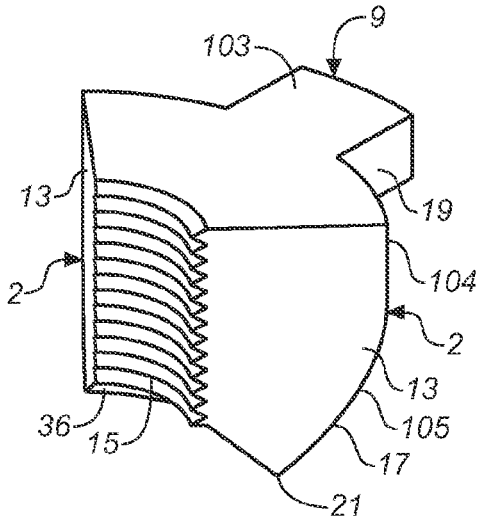
FIG. 18 is a perspective view of an insert segment of the take-up device of the present invention; the insert segment shown in FIG. 18 has smaller inner bore than the similar insert segment shown in FIG. 17.
Figure 19:
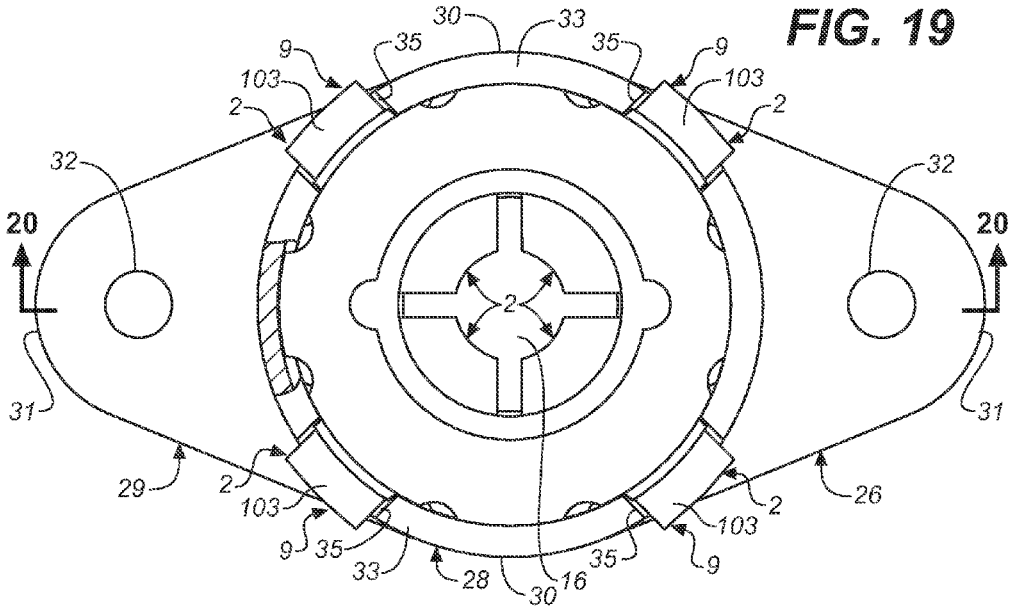
FIG. 19 is a top plan view of the take-up device of the present invention; the take-up device shown in FIG. 19 has a smaller inner bore than the similar take-up device shown in FIG. 13.

As best shown in FIGS. 12, 17 and 18, each insert segment 2 preferably has first and second substantially planar sides 13 perpendicular to the top surface 3. Preferably, the first substantially planar sides 13 extend downward from the first and second edges 6 of the top surface 3. The first and second substantially planar sides 13 are preferably orthogonal to each other. Each insert segment 2 preferably has a rough, threaded, concave inner bore-defining surface 14 that extends downward from the concave inner bore-defining edge 4 and connects the first and second substantially planar sides 13. Preferably, each bore-defining surface 14 is primarily a section of a rough, threaded, right circular cylindrical surface 15 that defines the inner bore 16. As shown in FIGS. 12 and 18, each insert segment 2 preferably has an outer bore-interfacing surface 17 that extends downward from the arc 7 of the outer bore edge 7. In the currently preferred embodiments of the invention the outer bore-interfacing surface 17 and the inner bore 16 preferably has a surface roughness of 125-250 micro-inches (3.2-6.3 μm).

As best shown in FIGS. 2 and 11, a portion 103 of the substantially planar top surface 3 of each insert segment 2 preferably extends radially outward away from the inner bore 16 to form the top surface 103 of each tab 9, bounded by the outer edge 10 and the two sides edges 12 of each tab 9. Preferably, each tab has a substantially planar outer surface 18 that descends from the outer edge 10. Each tab 9 preferably has first and second substantially planar side surfaces 19 that descend from the first and second side edges 12, respectively, of the tab 9. Preferably, each tab 9 has a substantially planar bottom surface 20 opposite the top surface 103 of the tab 9. In the currently preferred embodiments of the present invention, each tab 9 is 0.250 inches wide from the first side edge 12 to the second side edge 12, and each tab 9 is preferably 0.120 inches thick from the top surface 103 to the bottom surface 20.

As best shown in FIGS. 2, 12, 17 and 18, preferably the general shape of the lower portion of the outer bore-interfacing surfaces 17 of the insert segments 2 is collectively that of a spherical segment—a spherical cap with the top truncated or a spherical frustum. In the currently preferred embodiments of the present invention a radius of 0.5 inches is preferred. The insert segments 2 generally have the form of an inverted dome with the inverted apex cut off parallel to the base. If there are four insert segments 2, each is approximately one quarter of the spherical frustum and the spherical frustum is vertically quartered, and the quarters preferably spaced slightly apart. Two segments 2 side-by-side have the general shape of an inverted semi-dome. The outer bore-interfacing surfaces 17 preferably taper from the top surfaces 3 of the insert segments 2 to bottom edges 21 of the insert segments 2, reducing the cross-section of each insert segment 2 from the top surface 3 to the bottom edge 21. Preferably, the general shape of the upper portion 104 of the outer bore-interfacing surface 17 of the insert segments 2 is collectively that of a cylinder with tabs 9 splayed circumferentially. The lower portion 105 the outer bore-interfacing surface 17 of the insert segments 2 curves inward. In the currently preferred embodiments of the present invention, the substantially planar bottom surface 20 of each tab 9 joins the tapering outer bore-interfacing surface 17 of its insert segment 2 at a tab juncture 25 that has a radius of 0.020 inches. The insert segments 2 together preferably form an inverted dome with a central vertical through-bore.

Figure 16:
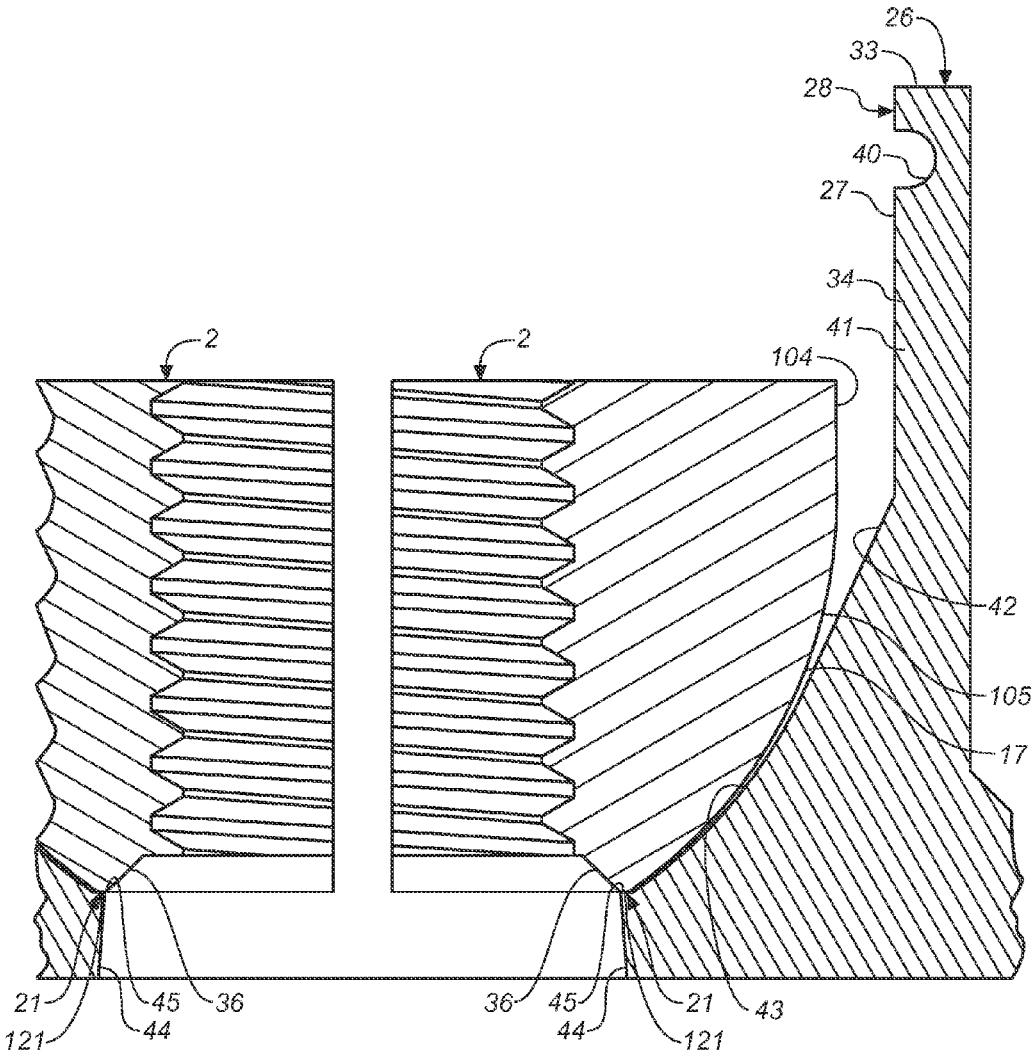
FIG. 16 is a cutaway cross-sectional elevation view of the interface between the insert segments and the outer bore of the take-up device housing of the present invention.
Figure 20:
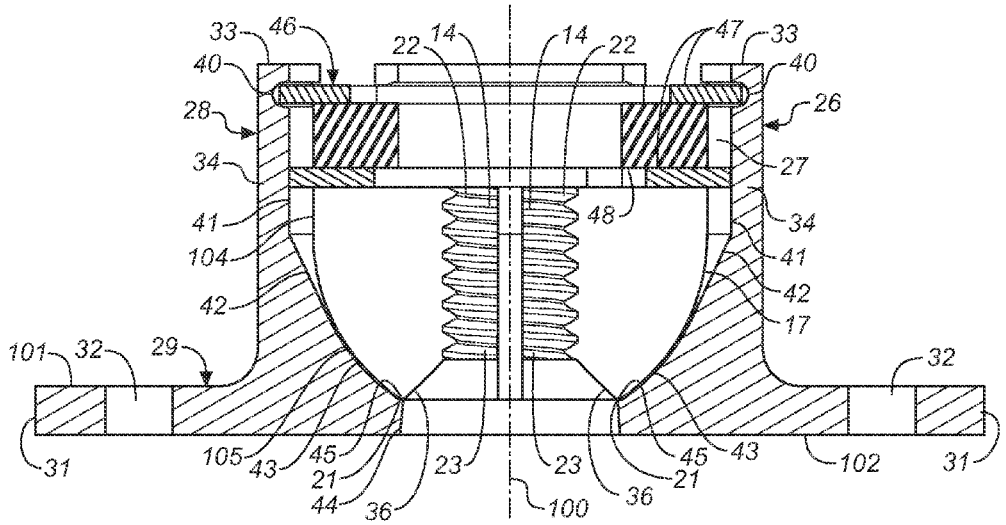
FIG. 20 is a cross-sectional elevation view of the take-up device of the present invention taken along view line 20-20 in FIG. 19; the take-up device shown in FIG. 20 has a smaller inner bore than the similar take-up device shown in FIG. 14.

As best shown in FIGS. 12, 14 and 20, the rough, preferably threaded, inner bore-defining surface 14 of each insert segment 2 extends from a top end 22 to a bottom end 23, where the inner bore 16 flares outward with a substantially annular widening taper surface 36, or chamfer 36, on each insert segment 2 that meets the bottom edge 21 of each insert segment. These flared, or beveled, bottom portions 36 of the inner bore 16 are where the tie rod or threaded bolt 24 is inserted; the flared portions 36 ease insertion of the tie rod or threaded bolt 24. Each substantially planar widening taper surface 36 is preferably oriented at 45 degrees to the top surfaces 3 of the insert segments 4 and at 45 degrees to the central axis 100 of the take-up device 1, with the acceptable range being up to 15 degrees more or less. Preferably, each taper surface 36 is a surface section of a conical frustum. In the currently preferred embodiments of the present invention, the flared bottom portions 36 widen the inner bore 16 to a maximum width of 0.545 inches across. In the currently preferred embodiments of the present invention, the bottom edge 21 is preferably not a true edge, but is instead a very narrow annular surface 21, a flat base 21 that helps to stabilize the insert segments 2. As shown in FIG. 16, in the currently preferred embodiments of the present invention, the bottom edge 21 of each insert segment is preferably 0.0085 inches across parallel to the top surface 3: the maximum width across the lowest part of the insert segments 2 collectively is 0.562 inches from edge 21 to edge 21 of opposed segments 2 when the insert segments 2 are resting on the ledge 45 of the outer bore 27; the height of the insert segments 2, measured from the top surface 3 to the bottom edge 21, is preferably 0.539 inches. The height of the insert segments 2 is sufficient to grasp enough of the tie rod or threaded bolt 24 for a secure connection 110 by connecting to multiple turns of the threaded bolt 24. In the currently preferred embodiments of the present invention, the insert segments 2 are held apart by the tie rod or threaded bolt 24, so that adjacent sides 13 of the insert segments 2 do not interface but are instead held 0.062 inches apart.

Currently, the inventors have engineered and developed two preferred sizes of the take-up device 1 of the present invention. The inventors contemplate developing additional sizes for larger sizes of tie rods 24 and will adjust dimensions to maximize the performance of the take-up device with the different tie rods 24. Currently, the two sizes differ only in the dimension of the right circular cylindrical surfaces 15 that define the inner bore 16, which in a first embodiment is sized to accept a ⅜-16 UNC threaded rod 24 (best shown in FIG. 20) and in a second embodiment is sized to accept a ½-13

UNC threaded rod 24 (best shown in FIG. 14). With the preferable spacing of 0.062 inches between the insert segments 2, the maximum diameter of the rough, threaded, concave inner bore-defining surface 14 (made up of the right circular cylindrical surfaces 15) of the inner bore 16 is 0.342 inches when the threaded rod is ⅜-16 UNC. When the threaded rod 24 is ½-13 UNC, the maximum diameter of the rough, threaded, concave inner bore-defining surface 14 (made up of the right circular cylindrical surfaces 15) of the inner bore 16 is 0.459 inches.

As best shown in FIGS. 13, 14, 19 and 20, the insert segments 2 fit into an outer bore 27 in a housing 26 that holds the segments 2 in the correct sectional arrangement to form the inner bore 16. The housing 26 is preferably a seamless, unitary member 26 with a vertical body 28 that is preferably cylindrical and contains the outer bore 27 and a horizontal plate 29 below the vertical body 28. The horizontal plate 29 has a top face 101 and a bottom face 102. Preferably, the horizontal plate 29 is shaped generally as an elongated rhombus with two relatively closely spaced corners 30 and two relatively distantly spaced corners 31. The two relatively closely spaced corners 30 and two relatively distantly spaced corners 31 are preferably rounded. The two closely spaced opposing corners 30 do not extend beyond the cylindrical body 28 and match the curvature of the cylindrical body 28 where the plate 29 and cylindrical body 28 coincide. The two distantly spaced opposing corners 31 are spaced away from the cylindrical body 28. The plate 29 has a fastener opening 32 between each distantly spaced 31 corner and the cylindrical body 28. In the currently preferred embodiments of the present invention, each of the fastener openings 32 has a diameter of 0.171 inches. The fastener openings 32 are preferably spaced 1.886 inches apart on center. The center of the outer bore 27 is 0.943 inches from the centers of the fastener openings 32.

Also, in the currently preferred embodiments of the present invention, the cylindrical vertical body 28 preferably has an outer diameter of 1.283 inches. The vertical body 28 has a top edge 33. The outer bore 27 within the vertical body 28 has a diameter at the top edge 33 of 1.123 inches. Therefore, the vertical body 28 has a wall 34 that is preferably 0.16 inches thick at the top edge 33. The cylindrical vertical body 28 is 1.209 inches in diameter from the middle of the wall 34 across to the middle of wall 34 opposite. The top edge 33 is preferably flat except where it is notched with a number of indentations or slots 35 that match the tabs 9 on the insert segments 2. Each tab 9 preferably fits in an indentation 35 and preferably extends outside the vertical body 28, and the interlock prevents the insert segments 2 from rotating around the central axis 100. The interface between the tabs 9 and the indentations 35 also helps to stabilize the insert segments 2, helping to keep them level especially when a threaded rod 24 is inserted into the inner bore 16. Rather than being screwed into the inner bore 16, the threaded rod 24 is preferably pushed in without rotation and the insert segments 2 react by moving apart and together, ratcheting when the threaded inner bore 16 interfaces with a threaded bolt 24. The compression member 46 allows the insert segments 2 to move up within the housing 26, and the upwardly-widening outer bore 27 allows the insert segments 2 to move apart. This allows the threaded bolt 24 to be inserted into the inner bore 16, and as the threaded bolt 24 and the threaded portion of inner surfaces 14 of the insert segments 2 slide against each other, the segments 2 are moved up and outwardly and down and inwardly repeatedly, the inward motion urged by the compression member 46 and the narrowing outer bore 27 in the housing 2. The threaded bolt 24 can only be inserted in one direction because when it is pulled down, the downwardly-narrowing outer bore 27 forces the insert segments 2 against the threaded rod 24 so that the threaded bolt 24 and the threaded portion of inner surfaces 14 of the insert segments 2 interlock as if the threaded bolt 24 had been screwed into a conventional solid nut.

Figure 5:
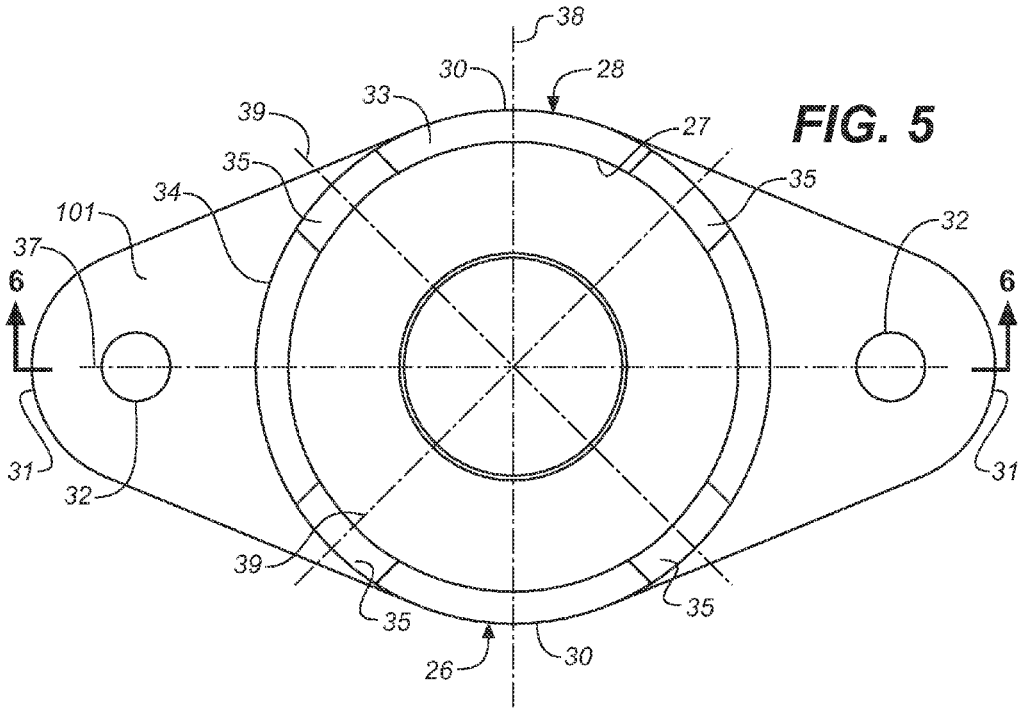
FIG. 5 is a top plan view of the housing of the take-up device of the present invention.

As shown in FIG. 5, preferably the housing 26 has a lateral horizontal axis 37 that passes through centers of the two fastener openings 32 and the center of the outer bore 27, which is preferably also the center of the cylindrical body 28, the housing 26 and the inner bore 16. Preferably, the housing 26 also has a medial horizontal axis 38 that also passes through the center of the outer bore 27 and is orthogonal to the lateral horizontal axis 37. The indentations 35 are preferably centered on first and second diagonal horizontal axes 39 that are 45 degrees off of the lateral horizontal axis 37 and the medial horizontal axis 38. In the currently preferred embodiments of the present invention, each indentation 35 is preferably 0.281 inches wide along the circumference of the top edge 33 of the cylindrical body 28. Preferably, each indentation 35 is 0.454 inches deep from the top edge 33 of the cylindrical body 28.

Figure 6:
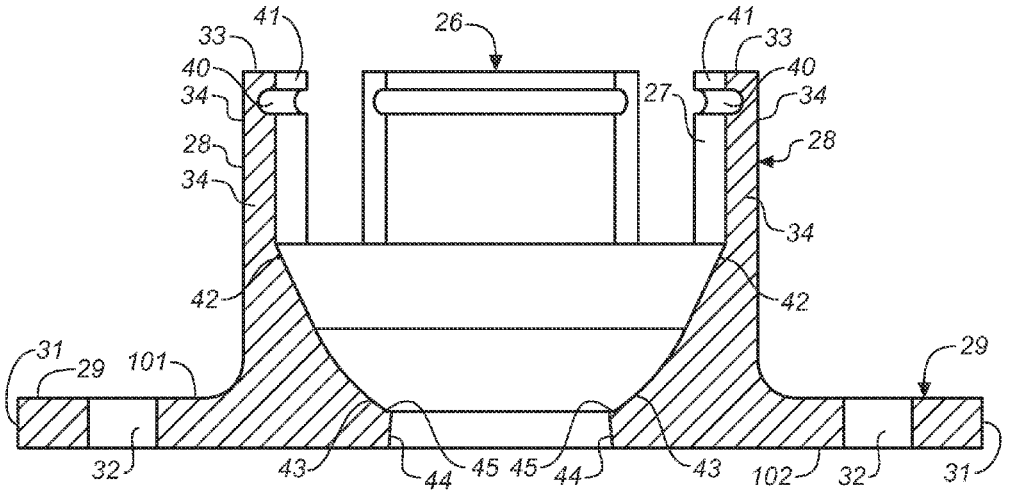
FIG. 6 is a cross-sectional elevation view of the housing of the take-up device of the present invention taken along view line 6-6 in FIG. 5.
Figure 7:
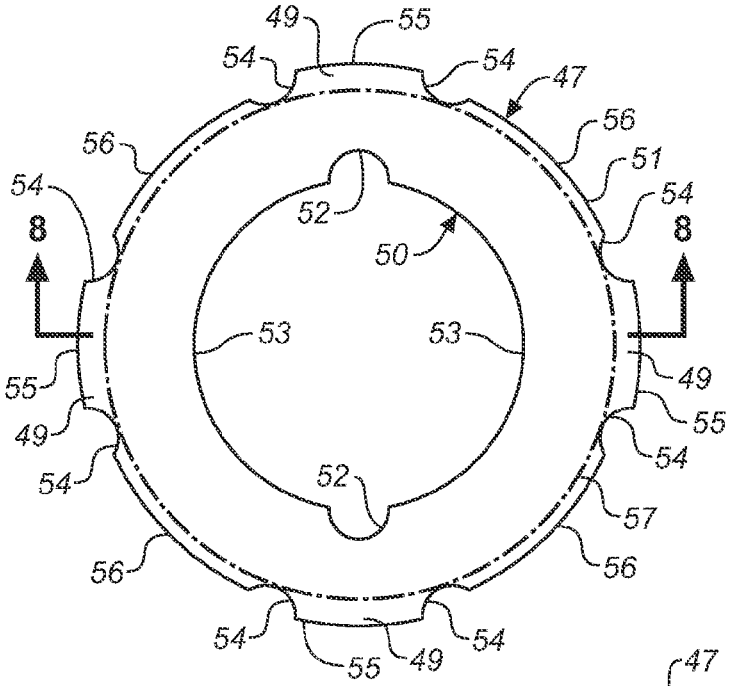
FIG. 7 is a top plan view of the upper and lower hard washers of the compression member of the take-up device of the present invention.
Figure 8:
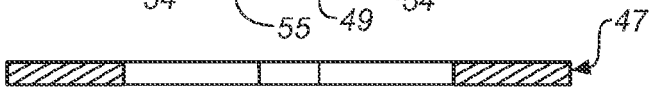
FIG. 8 is a cross-sectional elevation view of the hard washers of the take-up device of the present invention taken along view line 8-8 in FIG. 7.
Figure 9:
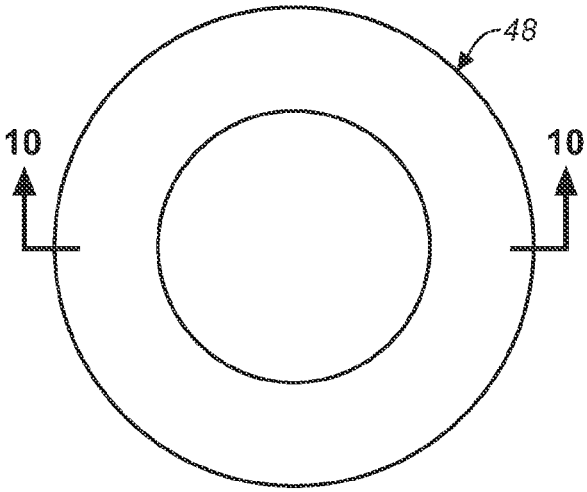
FIG. 9 is a top plan view of the soft washer of the take-up device of the present invention.
Figure 10:
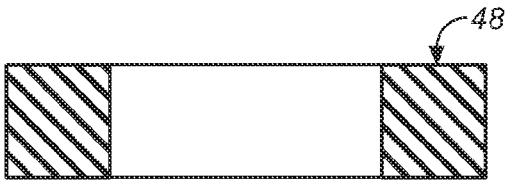
FIG. 10 is a cross-sectional elevation view of the soft washer of the take-up device of the present invention taken along view line 10-10 in FIG. 9.

As best shown in FIGS. 2, 6 and 16, in the currently preferred embodiments, the outer bore 27 preferably descends at right angles to the flat surface of the top edge 33. The outer bore 27 descends 0.045 inches to a groove 40 that runs parallel to the top edge 33. The groove 40 is 0.062 inches tall and has cross-section that is U-shaped in cross-section, with an internal radius of 0.031 inches. The outer bore 27 preferably descends another 0.324 inches straight down, creating an upper vertical portion 41 that descends a total of 0.431 inches straight down from the top edge 33; the groove 40 is within that upper vertical portion 41. At a depth of 0.431 inches, the outer bore 27 preferably tapers inward at an angle of 65 degrees relative to the bottom face 102 of the horizontal plate 29, creating a middle inward-angled portion 42. The middle inward-angled portion 42 transitions to a lower inward-curved portion 43 that preferably has a radius of 0.510 inches in a vertical plane. This closely matches the 0.5-inch radius, also in a vertical plane, of lower portion 105 of the outer bore-interfacing surfaces 17 of the insert segments 2. The lower inward-curved portion 43 reduces the taper angle from 65 degrees. The middle inward-angled portion 42 and the lower inward-curved portion 43 together reduce the diameter of the outer bore 27, and their collective depth is preferably 0.419 inches, so that with the upper vertical portion 41 the collective depth is preferably 0.85 inches. Below the lower inward-curved portion 43 the outer bore 27 has a bottom portion 44 that is flared and preferably has a depth of 0.091 inches and that slightly increases the diameter of the outer bore 27 from a minimum of 0.545 inches at the bottom face 102 of the horizontal plate 29 to 0.558 inches. The slight widening of the bottom flared portion 44 eases insertion of the threaded rod 24. Between the inward-curved portion 43 and the bottom flared portion 44 is a horizontal, or flat, ledge 45 that is 0.0115 inches wide and orthogonal to the central axis 100 of the housing 26. The diameter of the outer bore 27 is 0.568 inches at the bottom of the lower inward-curved portion 43 and is 0.545 inches at the top of the bottom flared portion 44. This horizontal ledge 45 helps to keep the insert segments 2 level when a threaded rod 24 is inserted into the ratcheting take-up device 1 to create the basic connection 110. The preferred total height of the outer bore is 0.941 inches.

As best shown in FIGS. 7-10, preferably the insert segments 2 are retained within the outer bore 27 by a compression member 46. The compression member 46 preferably comprises a lower hard washer 47, a middle soft washer 48 and an upper hard washer 47. The middle soft washer 48 is preferably made from a resilient material like rubber that, when compressed, stores energy and expands when compression forces are released. Preferably, the middle soft washer 48 is made from soft quick-recovery super-resilient polyurethane foam, which has a firmness at 25 percent deflection, of 4-8 psi, a tensile strength of 40 psi, a stretch limit of 100 percent, and a density of 15 pounds per cubic foot. The middle soft washer 48 functions like a standard metal compression spring and a spring could be used, but the washer 48 is preferred. In the currently preferred embodiments of the present invention, the middle soft washer 48 preferably a 0.235-inch thick ring with an outer diameter of 1 inch and an inner diameter of 0.567 inches. The inner diameters of the compression member 46 limit how far the insert segments 2 can tilt or rotate. The upper and lower hard washers 47 are preferably made from steel. Preferably, each has an inner edge 50, an outer edge 51, an upper surface 52 and a lower surface 53. Preferably, the inner edge 50 and the outer edge 51 are both generally circular. The inner edge preferably has a pair of inclusions 52, each with a preferred radius of 0.063 inches that evenly divide the remainder into two arcs 53 with a diameter of 0.562 inches. Preferably, the outer edge 51 has four pairs of inclusions 54, each with a preferred radius of 0.063 inches. Each pair of inclusions 54 preferably is 90 degrees apart around the circumference of the outer edge 51. Preferably, between the inclusions 54 of each pair is a small arc 55 that is preferably 0.254 inches wide. These four small arcs 55 preferably each have a diameter of 1.187 inches. Preferably, between each pair of inclusions 54 is a large arc 56 with a diameter of 1.108 inches. The preferred total of eight inclusions 54 in the outer edge 51 bound an inner area with a circumference 57 with a diameter of 1.068 inches. The upper and lower hard washers 47 are preferably 0.047 inches thick. Preferably, the small arcs 55, which project slightly from the rest of the outer edges 51 of the upper and lower hard washers 47, and are therefore on slight projections 49 that are inserted in the indentations 35 in the wall 34 of the cylindrical body 28 of the housing 26 of the take-up device 1. The lower hard washer 47 is stabilized by the interfaces between the small arcs 55 and the indentations 35. The upper hard washer 47 is rotated so small arcs 55 slide into the groove 40 in the wall 34 of the cylindrical body 28 of the housing 26 of the take-up device 1. This locks the upper hard washer 47 in place. The upper hard washer 47 holds the middle soft washer 48 and the lower hard washer 47 in place, and this whole compression member 46 holds the insert segments 2 down within the outer bore 27 of the take-up device 1. When the insert segments 2 push up, the middle soft washer 48 compresses and, because it is resilient, the middle soft washer 48 pushes the insert segments 2 down when the upper hard washer 47 is locked in place. The whole compression member 46 functions as a spring tailored for the best performance in this device 1 and connection 110. The interface between the outer bore-interfacing surfaces 17 of the insert segments 2 and the inward-angled and inward-curved portions 42 and 43 of the outer bore 27 forces the insert segments 2 together. The insert segments 2 clamp together on the tie rod or threaded bolt 24. The matching curvatures of the bore-interfacing surfaces 17 of the insert segments 2 and the inward-curved portions 43 of the outer bore 27 allow the insert segments 2 to rotate or swing on a horizontal axis generally orthogonal to, and intersecting with, the tie rod or threaded bolt 24 without diminishing the interface area. This allows the take-up device 1 to compensate for imperfect alignment of the tie rod or threaded bolt 24 without diminishing the strength of the connection 110. The insert segments 2 can tilt, or rotate, in any direction. Generally, the segments 2 need only rotate a maximum of two degrees from the central axis 100, but the ability to do this without diminishing the interface with the outer bore 27 and the strength of the connection 110 is substantially advantageous since tie rods or threaded bolts 24 are rarely, if ever, aligned perfectly.

Figure 3:
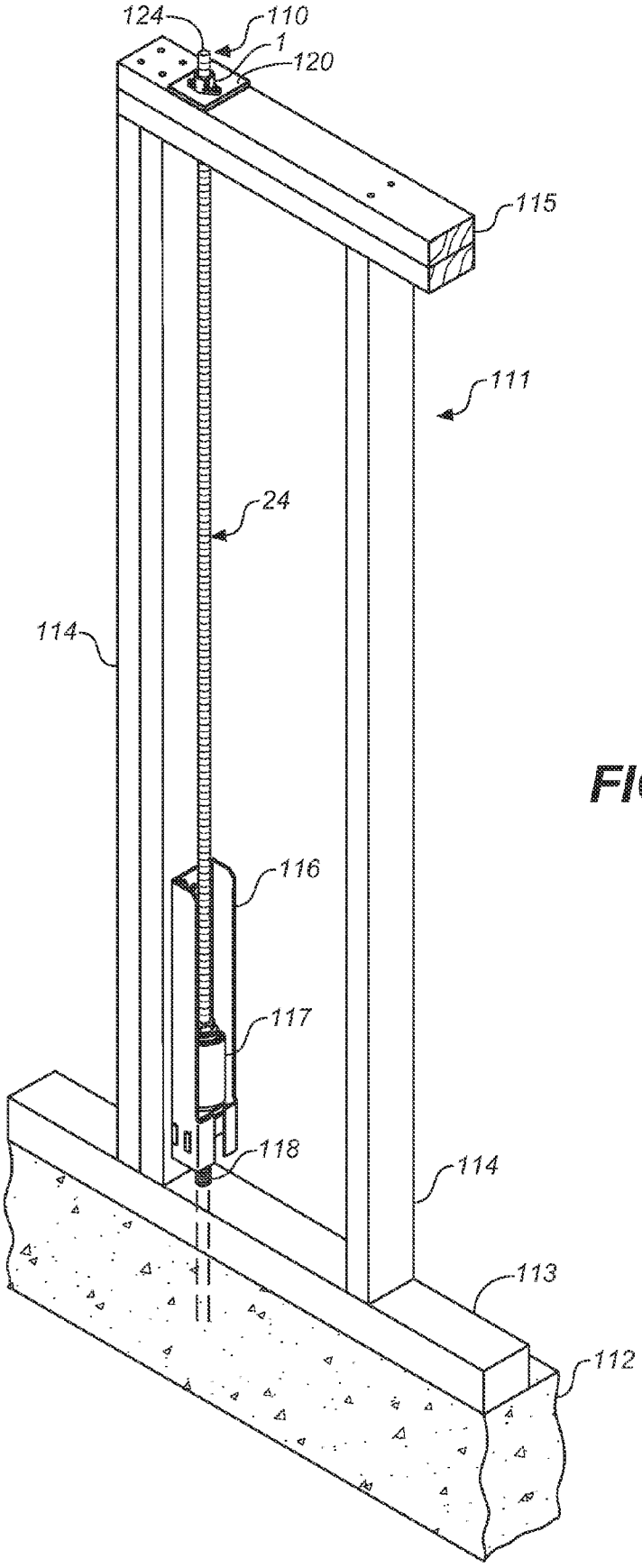
FIG. 3 a perspective view of a connection made with the take-up device of the present invention, showing the take-up device installed on the top plate of a stud wall.

As shown in FIG. 3, an anchor bolt 118 is embedded in a concrete foundation 112. The anchor bolt 118 passes through the horizontal bottom plate 113 of a wall 111, in this case the mudsill 113, and it attached to a coupler 117 that bears down on a holdown 116 that is mounted on one of the vertical wall studs 114. The coupler 117 joins the anchor bolt 118 to an in-line threaded rod 24 that runs parallel to the wall stud 114 and up through the double top plate 115, where it is secured to the top plate 115 by a take-up device 1 of the present invention that is fastened to the top plate 115 with a bearing plate 120 sandwiched between the bottom face 102 of the take-up device 1 and the top plate 115.

Figure 4:
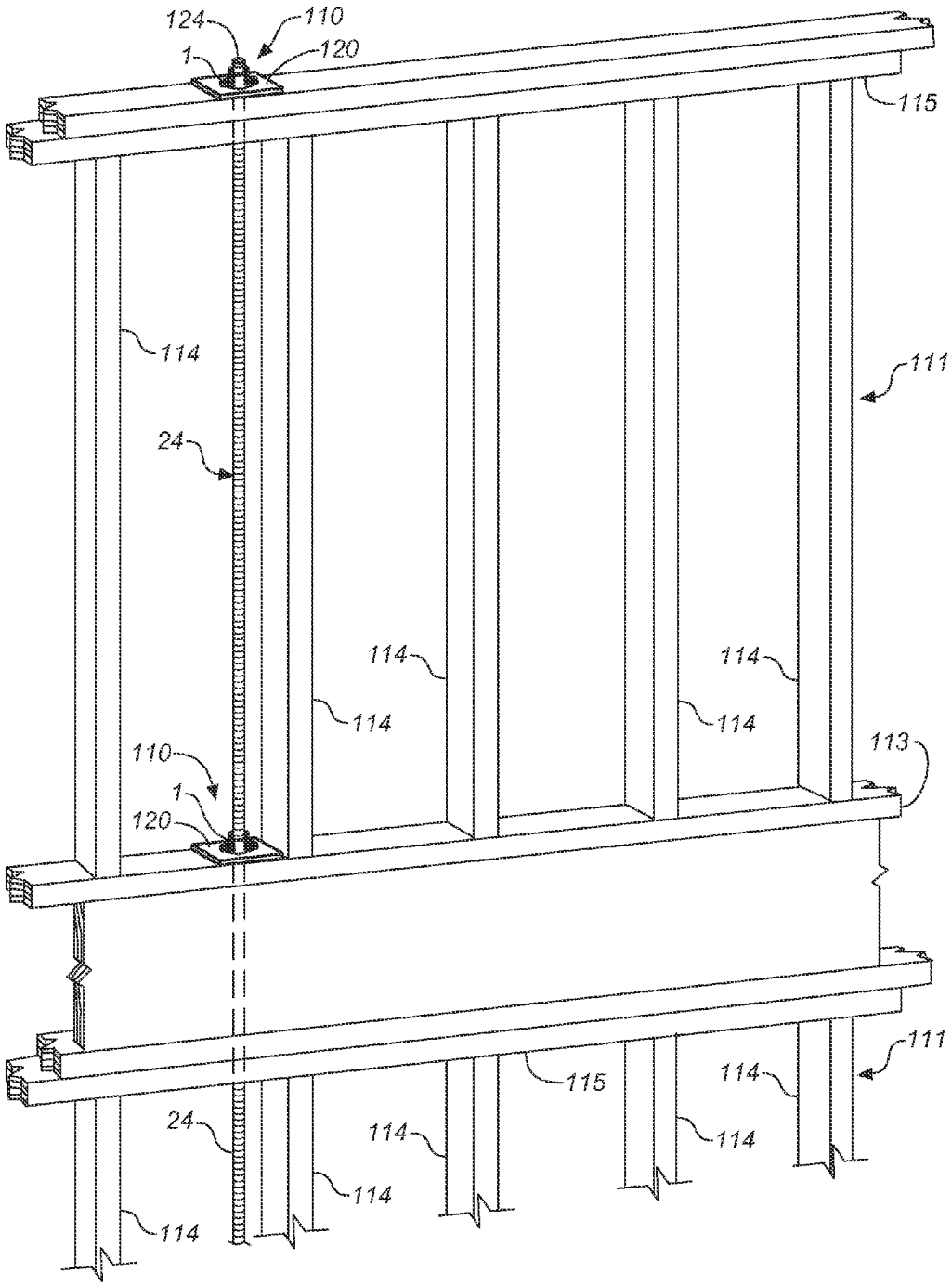
FIG. 4 is a perspective view of a connection made with the take-up device of the present invention, showing two take-up devices of the present invention, each installed on a different level of the same structure.

As shown in FIG. 4, take-up devices 1 of the present invention can be placed at every level of a multistory structure. In FIG. 4, a first take-up device 1 is shown fastened to the bottom plate 113 of an upper floor and a second take-up device 2 is attached to the top plate 115 directly above.

In its simplest form, the present invention is a take-up device 1 that has a housing 26 and a plurality of insert segments 2. The housing 26 has an outer bore 27 and the outer bore 27 has a lower inward-curved portion 43 that is frusto-spherical. The insert segments 2 each has an outer bore-interfacing surface 17 that interfaces with the inward-curved portion 43 of the outer bore 27 of the housing 26. The outer bore-interfacing surfaces 17 of the plurality of insert segments 2 are at least in part collectively frusto-spherical. Each insert segment 2 has a concave inner bore-defining surface 14 and the plurality of concave inner bore-defining surfaces 14 define an inner bore 16. Preferably, the outer bore 27 of the housing 26 has a ledge 45, the insert segments 2 each have a bottom edge 21, and the bottoms edges 21 of the insert segments 2 interface with the ledge 45 in the outer bore 27, stabilizing the insert segments 2. The take-up device 1 preferably has four insert segments 2. Each insert segment 2 preferably has a substantially planar top surface 3. The top surface 3 preferably has a concave inner bore-defining edge 4 with first and second ends 5, a convex outer bore edge 7 with first and second ends 8, a first substantially straight side edge 6 that connects the first end 5 of the inner bore-defining edge 4 to the first end 8 of the outer bore edge 7, and a second substantially straight side edge 6 that connects the second end 5 of the inner bore-defining edge 4 to the second end 8 of the outer bore edge 7. Each segment 2 preferably also has a tab 9 on the convex outer bore edge 7, an inner bore-defining surface 14 that descends from the inner bore-defining edge 4, and an outer bore-interfacing surface 17 that descends from the outer bore-defining edge 7 and tapers a bottom edge 21. Preferably, the inner bore 12 of the take-up device 1 is threaded.

The housing 26 preferably also has a horizontal plate 29 and a vertical body 28 that surmounts the horizontal plate 29 and the outer bore 27 of the housing 26 is contained within the vertical body 28. Preferably, the vertical body 28 is cylindrical and has an outer wall 34 with a top edge 33, a plurality of indentations 35 extend down from the top edge 33 of the wall 34, and a tab 9 of an insert segment 2 interfaces with each of the indentations 35 in the wall 34 of the cylindrical vertical body 28. The insert segments 2 are preferably retained within the outer bore 27 by a compression member 46. Preferably, the compression member 46 has an upper hard washer 47, and a resilient lower soft washer 48 that pushes the insert segments 2 downward in the outer bore 27 and is restrained from upward movement by the upper hard washer 47. The compression member 46 preferably also has a lower hard washer 47 that is between the resilient lower soft washer 48 and the insert segments 2. Preferably, the upper and lower hard washers 47 each have an outer edge 51 with a plurality of projections 49. The outer bore 27 preferably has a groove 40 connected to the indentations 35 in wall 34 of the cylindrical body 28. Preferably, the projections 49 of the upper hard washer 47 project into the groove 40 in the outer bore 27, restraining the compression member 46. The projections 49 of the lower hard washer 47 preferably project into the indentations 35 in wall 34 of the cylindrical body 28, stabilizing the compression member 46.

Preferably, the take-up device 1 is part of a connection 110 that has a first structural member 115 to which the take-up device 1 is fastened, and a tie rod 24 with a top end 124 at least partially held within the inner bore 16 of the take-up device 1 by a plurality of the insert segments 2. The first structural member 115 preferably is a top plate 115 in an at least partially wood frame wall 111, and a bearing plate 120 is disposed between the first structural member 115 and the take-up device 1. Preferably, the tie rod 24 is secured to a foundation 112 below the wood frame wall 111.

The outer bore 27 of the take-up device 1 preferably has a central vertical axis 100. Preferably, when the tie rod 24 is not parallel to the central vertical axis 100 of the outer bore 27, the insert segments 2 that hold the tie rod 24 are canted so the inner bore 16 is parallel to the tie rod 24 where the tie rod 24 is held by the insert segments 2 but the inner bore is not parallel to the central vertical axis 100 of the outer bore 27.

Preferably, the connection 110 is formed by inserting the top end 124 of the tie rod 24 into the inner bore 16 of the take-up device and fastening the take-up device 1 to the first structural member 115. The take-up device 1 is preferably fastened to the first structural member 115 with a plurality of screws or nails 119. Screws provide a stronger connection than nails, but nails are less expensive and can still often provide the necessary strength for the connection.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

We claim:

1. A take-up device (1) in a connection, the take-up device comprising:

a. a housing (26) with an outer bore (27) the outer bore (27) having a lower inward-curved portion (43) that is frusto-spherical;

b. a plurality of insert segments (2) primarily disposed in the outer bore (27) and primarily contained securely within the housing (26), each of which has an outer bore-interfacing surface (17) that interfaces with the inward-curved portion (43) of the outer bore (27) of the housing (26), wherein:

i. the outer bore-interfacing surfaces (17) of the plurality of insert segments (2) collectively form a segmented frusto-spherical surface where the outer bore-interfacing surfaces (17) interface with the outer bore (27);

ii. each insert segment (2) has a concave inner bore-defining surface (14) and the plurality of concave inner bore-defining surfaces (14) form a generally tubular inner bore (16);

c. wherein the take-up device is fastened to a first structural member (115); and d. a tie rod (24) is at least partially held within the inner bore (16) of the take-up device (1) by a plurality of the insert segments (2), the tie rod (24) having a top end (124) that can pass through the housing (26).

2. The take-up device (1) of claim 1 wherein:

a. the outer bore (27) of the housing (26) has a ledge (45) proximate the most constricted part of the inward-curved portion (43);

b. the insert segments (2) each have a top surface (3) and a bottom edge (21) opposite the top surface;

c. the bottoms edges (21) of the insert segments (2) interface with the ledge (45) in the outer bore (27), stabilizing the insert segments (2).

3. The take-up device (1) of claim 2 wherein the bottom edge (21) of the insert segments (2) has a flat section (121) that interfaces with the ledge (45) in the outer bore (27).

4. The take-up device (1) of claim 3 wherein:

a. the flat section (121) of each bottom edge (21) of the insert segments (2) is 0.0085 inches wide;

b. the ledge (45) in the outer bore (27) is 0.0115 inches wide; and c. each insert segment (2) is 0.539 inches tall from the top surface (3) to the bottom edge (21).

5. The take-up device (1) of claim 1 having four insert segments (2), each insert segment (2) having:

a. a substantially planar top surface (3) with:

i. a concave inner bore-defining edge (4) with first and second ends (5);

ii. a convex outer bore edge (7) with first and second ends (8);

iii. a first substantially straight side edge (6) that connects the first end (5) of the inner bore-defining edge (4) to the first end (8) of the outer bore edge (7); and iv. a second substantially straight side edge (6) that connects the second end (5) of the inner bore-defining edge (4) to the second end (8) of the outer bore edge (7);

b. a tab (9) on the convex outer bore edge (7), wherein:

i. the inner bore-defining surface (14) descends from the inner bore-defining edge (4); and ii. the outer bore-interfacing surface (17) descends from the outer bore-defining edge (7) and tapers to a bottom edge (21).

6. The take-up device (1) of claim 5 wherein the inner bore (16) is threaded.

7. The take-up device (1) of claim 5 wherein:

a. the take-up device (1) has a central axis (100);

b. each of the tabs (9) on the convex outer bore edges (7) of the insert segments (2) has a outer edge (10), two sides edges (12), a top surface (103) and a bottom surface (20);

c. the outer edges (10) of the tabs (9) on opposed insert segments (2) are 1.375 inches apart;

d. the two side edges (12) of each tab (9) are 0.25 inches apart;

e. the top surface (103) and the bottom surface (20) of each tab (9) are 0.12 inches apart;

f. the outer bore-interfacing surfaces (17) of the insert segments (2) have a radius of 0.5 inches;

g. the bottom surface (20) of each tab (9) joins the outer bore-interfacing surface (17) of each tab (9) at a tab juncture (25) that has a radius of 0.02 inches;

h. each concave inner-bore defining surface (14) of each insert segment (2) has a bottom end (23) with a chamfer (36) that is between 30 and 60 degrees relative to the central axis (100) of the take-up device; and i. the chamfer (36) widens the inner bore (16) to a maximum width o 0.545 inches.

8. The take-up device (1) of claim 1 wherein:

a. the housing (26) additionally comprises a vertical body (28); and b. the outer bore (27) of the housing (26) is contained within the vertical body (28).

9. The take-up device (1) of claim 8 wherein:

a. the housing (26) additionally comprises a horizontal plate (29) surmounted by the vertical body (28).

10. The take-up device (1) of claim 8 wherein:

a. the vertical body (28) has an outer wall (34) with a top edge (33);

b. a plurality of indentations (35) extend down from the top edge (33) of the wall (34); and c. a tab (9) of an insert segment (2) interfaces with each of the indentations (35) in the wall (34) of the cylindrical body (28).

11. The take-up device (1) of claim 10 wherein:

a. the vertical body (28) of the housing (26) has an outer diameter of 1.282 inches at the top edge (33) of the outer wall (34) of the vertical body (28);

b. the outer bore (27) of the housing (26) has a diameter of 1.209 inches at the top edge (33) of the outer wall (34) of the vertical body (28); and c. each indentation (35) in the outer wall (34) is 0.454 inches deep.

12. The take-up device (1) of claim 1 wherein the insert segments (2) are retained within the outer bore (27) by a compression member (46).

13. The take-up device (1) of claim 12 wherein the compression member comprises:

a. an upper hard washer (47) and;

b. a resilient spring (48) that pushes the insert segments (2) into the outer bore (27) and is restrained from upward movement by the upper hard washer (47).

14. The take-up device (1) of claim 13 wherein the resilient spring (48) is a soft washer (48).

15. The take-up device (1) of claim 14 wherein:

a. the compression member (46) additionally comprises a lower hard washer (47) that is between the resilient lower soft washer (48) and the insert segments (2).

16. The take-up device (1) of claim 15 wherein:

a. the vertical body (28) has an outer wall (34) with a top edge (33);

b. a plurality of indentations (35) extend down from the top edge (33) of the wall (34);

c. the upper hard washer (47) has an outer edge (51) with a plurality of projections (49);

d. the outer bore (27) has a groove (40) connected to the indentations (35) in wall (34) of the vertical body (28); and e. the projections (49) of the upper hard washer (47) project into the groove (40) in the outer bore (27), restraining the compression member (46).

17. The take-up device (1) of claim 16 wherein:

a. the lower hard washer (47) has an outer edge (51) with a plurality of projections (49); and b. the projections (49) of the lower hard washer (47) project into the indentations (35) in wall (34) of the vertical body (28), stabilizing the compression member (46).

18. The take-up device (1) of claim 17 wherein:

a. the groove (40) in the outer bore (27) is 0.062 inches tall, 0.045 inches below the top edge (33) of the outer wall (34), and has a U-shaped cross section with an internal radius of 0.031 inches;

b. the outer bore (27) is 0.941 inches in height, and the outer bore (27) has an upper vertical portion (41) that descends 0.431 inches from the top edge (33), a middle inward-angled portion (42) that descends from the upper vertical portion (41), a lower inward-curved portion (43) with a radius of 0.510 inches that descends from the middle inward-angled portion (42), and a flared bottom portion (44) with a depth of 0.091 inches that descends from the lower inward-curved portion (43).

19. The take-up device (1) of claim 17 wherein:

a. the upper hard washer (47) has a an inner edge (50) with a pair of substantially semicircular inclusions (52), each with a radius of 0.063 inches, and a pair of arcs (53) between the inclusions (52), both arcs (53) having a diameter of 0.562 inches;

b. the outer edge (51) of the upper hard washer (47) has four pairs of substantially semicircular inclusions (54), each with a radius of 0.063 inches, four small arcs (55), each on a projection (49) bounded by a pair of inclusions (54) and with a diameter of 1.187 inches, and four large arcs (56) between each pair of inclusions (54) that each has a diameter of 1.108 inches; and c. the upper hard washer (47) is 0.047 inches thick.

20. The connection (110) of claim 1 wherein:

a. the first structural member (115) is a top plate (115) in an at least partially wood frame wall (111), and the take-up device (1) rests on a bearing plate (120) attached to the top plate (115) with the same fasteners (119) as the take-up device (1).

21. The connection (110) of claim 20 wherein:

a. the tie rod (24) is secured to a foundation (112) below the wood frame wall (111).

22. The connection (110) of claim 1 wherein:

a. the outer bore (27) of the take-up device (1) has a central vertical axis (100);

b. the tie rod (24) is not parallel to the central vertical axis (100) of the outer bore (27); and c. the insert segments (2) that hold the tie rod (24) are canted so the inner bore (16) is parallel to the tie rod (24) where the tie rod (24) is held by the insert segments (2) but the inner bore is not parallel to the central vertical axis (100) of the outer bore (27).

23. A method of forming the connection (110) of claim 1 comprising the steps of:

a. inserting the top end (124) of the tie rod (24) into the inner bore (16) of the take-up device; and b. fastening the take-up device (1) to the first structural member (115).

24. The method of claim 23 additionally comprising the steps of:

a. inserting the tie rod (24) through a bottom portion (44) of the outer bore (27) in the housing (26).

25. The method of claim 24 additionally comprising the steps of:

a. inserting the tie rod (24) through the first structural member (115).

26. The method of claim 25 wherein:

a. the take-up device (1) is fastened to the first structural member (115) with a plurality of screws (119).

27. A take-up device (1) in a connection, the take-up device comprising:

a. a housing (26) with an outer bore (27) the outer bore (27) having a lower inward-curved portion (43) that is frusto-spherical;

b. a plurality of insert segments (2) primarily disposed in the outer bore (27) and primarily contained securely within the housing (26), each of which has an outer bore-interfacing surface (17) that interfaces with the inward-curved portion (43) of the outer bore (27) of the housing (26), wherein:

i. the outer bore-interfacing surfaces (17) of the plurality of insert segments (2) collectively form a segmented frusto-spherical surface that interfaces with at least a portion of the lower inward-curved portion (43) of the outer bore (27) of the housing (26);

ii. each insert segment (2) has a concave inner bore-defining surface (14) and the plurality of concave inner bore-defining surfaces (14) form a generally tubular inner bore (16);

c. wherein the take-up device is fastened to a first structural member (115); and d. a tie rod (24) is at least partially held within the inner bore (16) of the take-up device (1) by a plurality of the insert segments (2), the tie rod (24) having a top end (124) that can pass through the housing (26).

28. The take-up device (1) of claim 27 wherein:

a. the outer bore (27) of the housing (26) has a ledge (45) proximate the most constricted part of the inward-curved portion (43);

b. the insert segments (2) each have a top surface (3) and a bottom edge (21) opposite the top surface; and c. the bottoms edges (21) of the insert segments (2) interface with the ledge (45) in the outer bore (27), stabilizing the insert segments (2).

29. The take-up device (1) of claim 28 wherein the bottom edge (21) of the insert segments (2) has a flat section (121) that interfaces with the ledge (45) in the outer bore (27).

30. The take-up device (1) of claim 27 having four insert segments (2), each insert segment (2) having:

a. a substantially planar top surface (3) with:

i. a concave inner bore-defining edge (4) with first and second ends (5);

ii. a convex outer bore edge (7) with first and second ends (8);

iii. a first substantially straight side edge (6) that connects the first end (5) of the inner bore-defining edge (4) to the first end (8) of the outer bore edge (7); and iv. a second substantially straight side edge (6) that connects the second end (5) of the inner bore-defining edge (4) to the second end (8) of the outer bore edge (7);

b. a tab (9) on the convex outer bore edge (7), wherein:

i. the inner bore-defining surface (14) descends from the inner bore-defining edge (4); and ii. the outer bore-interfacing surface (17) descends from the outer bore-defining edge (7) and tapers to a bottom edge (21).

31. The take-up device (1) of claim 30 wherein the inner bore (16) is threaded.

32. The take-up device (1) of claim 27 wherein:

a. the housing (26) additionally comprises a vertical body (28); and b. the outer bore (27) of the housing (26) is contained within the vertical body (28).

33. The take-up device (1) of claim 32 wherein:

a. the housing (26) additionally comprises a horizontal plate (29) surmounted by the vertical body (28).

34. The take-up device (1) of claim 32 wherein:

a. the vertical body (28) has an outer wall (34) with a top edge (33);

b. a plurality of indentations (35) extend down from the top edge (33) of the wall (34); and c. a tab (9) of an insert segment (2) interfaces with each of the indentations (35) in the wall (34) of the cylindrical body (28).

35. The take-up device (1) of claim 27 wherein the insert segments (2) are retained within the outer bore (27) by a compression member (46).

36. The take-up device (1) of claim 35 wherein the compression member comprises:

a. an upper hard washer (47) and;

b. a resilient spring (48) that pushes the insert segments (2) into the outer bore (27) and is restrained from upward movement by the upper hard washer (47).

37. The take-up device (1) of claim 36 wherein the resilient spring (48) is a soft washer (48).

38. The take-up device (1) of claim 37 wherein:

a. the compression member (46) additionally comprises a lower hard washer (47) that is between the resilient lower soft washer (48) and the insert segments (2).

39. The take-up device (1) of claim 38 wherein:

a. the vertical body (28) has an outer wall (34) with a top edge (33);

b. a plurality of indentations (35) extend down from the top edge (33) of the wall (34);

c. the upper hard washer (47) has an outer edge (51) with a plurality of projections (49);

d. the outer bore (27) has a groove (40) connected to the indentations (35) in wall (34) of the vertical body (28); and e. the projections (49) of the upper hard washer (47) project into the groove (40) in the outer bore (27), restraining the compression member (46).

40. The take-up device (1) of claim 39 wherein:

a. the lower hard washer (47) has an outer edge (51) with a plurality of projections (49); and b. the projections (49) of the lower hard washer (47) project into the indentations (35) in wall (34) of the vertical body (28), stabilizing the compression member (46).

41. The connection (110) of claim 27 wherein:

a. the outer bore (27) of the take-up device (1) has a central vertical axis (100);

b. the tie rod (24) is not parallel to the central vertical axis (100) of the outer bore (27); and c. the insert segments (2) that hold the tie rod (24) are canted so the inner bore (16) is parallel to the tie rod (24) where the tie rod (24) is held by the insert segments (2) but the inner bore is not parallel to the central vertical axis (100) of the outer bore (27).

* * * * *